US007115015B2

(12) United States Patent
Horii et al.

(10) Patent No.: US 7,115,015 B2
(45) Date of Patent: Oct. 3, 2006

(54) SPORT CLOTHING WITH CUPS

(75) Inventors: Katsuko Horii, Kyoto (JP); Yukiko Funahashi, Kyoto (JP)

(73) Assignee: Wacoal Corporation, Kyoto (JP)

( * ) Notice: Subject to any disclaimer, the term of this patent is extended or adjusted under 35 U.S.C. 154(b) by 494 days.

(21) Appl. No.: 10/362,729

(22) PCT Filed: Jul. 16, 2001

(86) PCT No.: PCT/JP01/06118

§ 371 (c)(1),
(2), (4) Date: Feb. 24, 2003

(87) PCT Pub. No.: WO02/15728

PCT Pub. Date: Feb. 28, 2002

(65) Prior Publication Data

US 2003/0157866 A1 Aug. 21, 2003

(30) Foreign Application Priority Data

Aug. 23, 2000 (JP) ..... 2000-252935

(51) Int. Cl.
*A41C 3/08* (2006.01)

(52) U.S. Cl. ..... 450/33; 450/31; 2/67

(58) Field of Classification Search ..... 450/7–11, 450/14–18, 23, 26–28, 30–33, 59; 2/69, 2/67, 73, 78.1–78.4, 105, 106
See application file for complete search history.

(56) References Cited

U.S. PATENT DOCUMENTS 4,440,174 A * 4/1984 Cordova ..... 450/31
4,564,015 A * 1/1986 Friedman ..... 450/31
4,956,878 A * 9/1990 Boynton ..... 2/67
5,033,986 A * 7/1991 Feigenbaum et al. ..... 450/30
5,478,275 A * 12/1995 Malm ..... 454/139
5,678,246 A * 10/1997 Cooley et al. ..... 2/67
5,823,851 A 10/1998 Dicker
5,871,388 A 2/1999 Lambert (Continued)

FOREIGN PATENT DOCUMENTS

JP 57-5407 1/1982

(Continued)

OTHER PUBLICATIONS

Patent Abstracts of Japan for JP01-177213 published on Dec. 18, 1989.

(Continued)

*Primary Examiner*—Gloria M. Hale
(74) *Attorney, Agent, or Firm*—Darby & Darby

(57) ABSTRACT

The present invention provides a sport clothing product with cups excellent in a shaping (bust uplifting) function, in which the stability of bust does not deteriorate even upon vigorous arm movements. A cup suspending cord (5R) of a right cup portion (2R) extends in the upper left direction, and a cup suspending cord (5L) of a left cup portion (2L) extends in the upper right direction, so that they are attached to a neck hole hem part (16), whereas respective extensions of the cup suspending cords (5L, 5R) intersect each other above the neck hole hem part (16). Movements of cup portions caused by vigorous arm movements accompanying exercises are greatly alleviated, whereby actions of cup suspending members at the time of raising arms function so as to lift up the cup portions in so-called "centering" directions.

17 Claims, 18 Drawing Sheets

U.S. PATENT DOCUMENTS

| | | | | |
|---|---|---|---|---|
| 6,162,111 | A * | 12/2000 | Heroff | 450/30 |
| 6,336,840 | B1 * | 1/2002 | Heroff | 450/30 |
| 6,443,805 | B1 * | 9/2002 | Kirkwood | 450/31 |
| 6,811,462 | B1 * | 11/2004 | Kenneally | 450/30 |
| 6,846,217 | B1 * | 1/2005 | Struble et al. | 450/31 |

FOREIGN PATENT DOCUMENTS

| | | | |
|---|---|---|---|
| JP | 60-67313 | | 5/1985 |
| JP | 01-177213 | | 12/1989 |
| JP | 02-264002 | | 10/1990 |
| JP | 2-264002 | A | 10/1990 |
| JP | 06-83011 | | 11/1994 |
| JP | 3042769 | | 8/1997 |
| JP | 3042769 | U | 8/1997 |
| JP | 3052845 | | 10/1998 |
| JP | 10-310908 | | 11/1998 |
| JP | 10-310908 | A | 11/1998 |
| JP | 11-050310 | | 2/1999 |
| JP | 11-140708 | | 5/1999 |
| JP | 11-140708 | A | 5/1999 |
| JP | 11-256404 | | 9/1999 |
| JP | 11-256404 | A | 9/1999 |
| JP | 2000-144503 | | 5/2000 |
| JP | 2000-144503 | A | 5/2000 |
| JP | 2000-212802 | | 8/2000 |
| JP | 2000-212802 | A | 8/2000 |

OTHER PUBLICATIONS

Patent Abstracts of Japan for JP60-67313 published on May 13, 1985.

Patent Abstracts of Japan for JP3042769 published on Aug. 13, 1997.

Patent Abstracts of Japan for JP11-256404 published on Sep. 21, 1999.

Patent Abstracts of Japan for JP57-5407 published on Jan. 12, 1982.

Patent Abstracts of Japan for JP11-140708 published on May 25, 1999.

Patent Abstracts of Japan for JP06-83011 published on Nov. 29, 1994.

Patent Abstracts of Japan for JP2000-212802 published on Aug. 2, 2000.

Patent Abstracts of Japan for JP10-310908 published on Nov. 24, 1998.

Patent Abstracts of Japan for JP02-264002 published on Oct. 26, 1990.

Patent Abstracts of Japan for JP3052845 published on Oct. 9, 1998.

Patent Abstracts of Japan for JP11-050310 published on Feb. 23, 1999.

Microfilm of the specification and drawings annexed to the request of Japanese Utility Model Application No. 74359/1988 (Laid-open No. 177213/1989), Nikki K.K., Dec. 18, 1989, Figs. 1 to 2.

Microfilm of the specification and drawings annexed to the request of Japanese Utility Model Application No. 160905/1983 (Laid-open No. 67313/1985), Wacoal Corporation, May 13, 1985, Figs. 2 to 3.

Microfilm of the specification and drawings annexed to the request of Japanese Utility Model Application No. 81531/1980 (Laid-open No. 5407/1982), Hiroshi Yoshihara, Jan. 12, 1982, Fig. 2.

CD-ROM of the specification and drawings annexed to the request of Japanese Utility Model Application No. 27016/1993 (Laid-open No. 83011/1994), Michiko Sano, Nov. 29, 1994, Fig. 1.

Notification of the First Office Action dated Feb. 4, 2005 from the Patent Office of the People's Republic of China.

* cited by examiner

SPORT CLOTHING WITH CUPS

CROSS REFERENCE TO PRIOR RELATED APPLICATIONS

This application is a U.S. national phase application under 35 U.S.C. § 371 of International Patent Application No. PCT/JP01/06118, filed Jul. 16, 2001, and claims the benefit of Japanese Patent Application No. 2000-252935, filed Aug. 23, 2000, both of which are incorporated by reference herein. The International Application was published in Japanese on Feb. 28, 2002 as International Publication No. WO 02/15728 A1 under PCT Article 21(2).

TECHNICAL FIELD

The present invention relates to women's sport clothing, for example, sport clothing with cups such as swimsuits, leotards, and sport underwear.

BACKGROUND ART

Sport clothing products such as women's swimsuits include those known as sport clothing with cups in which a pair of right and left cup portions are disposed in the body portion thereof. The right (left) cup portion is attached to the body portion by a right (left) side cloth and a right (left) cup suspending cord. One of end parts of the right (left) cup suspending cord is sewn to an upper edge part of the right (left) cup portion. The other end part of the right (left) cup suspending cord is sewn to the hem part of a right (left) armhole (a hole for passing an arm therethrough) in the body portion (type 1) or sewn to the hem part of a neck hole (a hole for passing a head therethrough) in the body portion (type 2). Type 1 is disclosed in Japanese Patent Application Laid-Open No. HEI 2-264002, for example. Type 2 is disclosed in Japanese Utility Model Application Laid-Open No. SHO 60-67313, Japanese Utility Model Application Laid-Open No. HEI 1-177213, and Japanese Utility Model Publication No. 3042769, for example. Known as a modification of type 2 is a swimsuit in which the other end part of the right (left) cup suspending cord is connected to the neck hole hem part by a hook. In this type, the other end part of the right (left) cup suspending cord can be attached to and removed from the hem part of the neck hole.

DISCLOSURE OF THE INVENTION

However, the conventional sport clothing products with cups such as those mentioned above have been problematic in that, depending on movements of the wearer's arms, the holding of bust becomes unstable and the shaping of bust is hard to keep. These will be explained in detail in the following.

In general, sport clothing products with cups are formed from a material having excellent contraction and expansion properties, whereby they come into close contact with a human body. There are cases where a wearer alternately moves the right and left arms upward in large strokes, for example, such as crawling in swimming. Here, as a shoulder is lifted up from the base part of the arm, the shoulder part of the body portion of clothing greatly expands upward. As a consequence, the arm hole hem part is pulled so as to expand upward along with the movement of the shoulder part. Also, along with the movement of the shoulder part, the neck hole hem part in a portion near the shoulder is pulled so as to expand upward.

Therefore, in the case of the above-mentioned type 1, the right (left) cup suspending cord is strongly pulled up since a strong upward pulling force acts on the right (left) armhole. This causes a problem that the holding of bust becomes unstable, and a problem that the shaping of bust is hard to keep.

In the case of the above-mentioned type 2, on the other hand, the right (left) cup suspending cord is lifted up since an upward pulling force acts on the right (left) side portion of the neck hole. Though this pulling force is weaker than the pulling force in type 1, it causes the above-mentioned two problems as in type 1. In the case of swimsuits in particular, a material having a relatively strong elasticity is used in the neck hole hem part in order to prevent water from entering from the neck hole. Consequently, while the movement (stroke) in the neck hole hem part is smaller than that in the arm hole hem part, the force (power) for lifting up the cup suspending cord is stronger. Therefore, the holding of bust tends to become unstable, and the bust shaping function is likely to be lost.

It is an object of the present invention to provide a sport clothing product with cups in which, even upon vigorous arm movements, the holding of bust is stable, whereas its bust shaping function (bust uplifting function) is excellent.

The sport clothing product with cups in accordance with the present invention comprises a body portion having a defining portion for defining a first armhole, a defining portion for defining a second armhole, and a defining portion for defining a neck hole; first and second cup portions disposed in the body portion; a first cup suspending member having a pair of end parts; and a second cup suspending member having a pair of end parts; wherein one end part of the second cup suspending member is attached to the second cup portion; wherein the other end part of the second cup suspending member is attached to the body portion such that the second cup is pulled toward the first cup when a pulling force acts on a part of the neck hole defining portion located on the first armhole side and/or the first armhole defining portion; wherein one end part of the first cup suspending member is attached to the first cup portion; and wherein the other end part of the first cup suspending member is attached to the body portion such that the first cup is pulled toward the second cup when a pulling force acts on a part of the neck hole defining portion located on the second armhole side and/or the second armhole defining portion.

In the present invention, the other end part of the second cup suspending member is attached to the body portion such that the second cup is pulled toward the first cup when a pulling force acts on a part of the neck hole defining portion located on the first armhole side and/or the first armhole defining portion. On the other hand, the other end part of the first cup suspending member is attached to the body portion such that the first cup is pulled toward the second cup when a pulling force acts on a part of the neck hole defining portion located on the second armhole side and/or the second armhole defining portion.

Therefore, the second cup portion is lifted up by the second cup suspending member when one arm is raised, whereas the first cup portion is lifted up by the first cup suspending member when the other arm is raised. As a consequence, the movements of the first and second cup portions caused by vigorous arm movements are greatly alleviated.

Directions in which the cup portions are lifted up by the cup suspending members when the arms are raised are such that the first cup portion is lifted up in the upward direction of the second cup portion, whereas the second cup portion is lifted up in the upward direction of the first cup portion. Hence, they are lifted up in so-called "centering" directions, whereby a shaping function of beautifully centering/uplifting the bust at the time of exercising can be exhibited. In the present invention, the "first" and "second" are defined such that one of them is on the right side when the other is on the left side, and vice versa, for example.

Also, the sport clothing product with cups in accordance with the present invention comprises a clothing portion having a front body portion adapted to come into close contact with a human body; first and second cup portions disposed on the human body side of the front body portion; a first cup suspending member having a pair of end parts; and a second cup suspending member having a pair of end parts; wherein one end part of the first cup suspending member is attached to the first cup portion; wherein one end part of the second cup suspending member is attached to the second cup portion; and wherein the other end part of the first cup suspending member and the other end part of the second cup suspending member are attached to the front body portion of the clothing portion such that the first cup suspending member and the second cup suspending member intersect each other or respective extensions of the first and second cup suspending members intersect each other.

In the present invention, the first and second cup suspending members are attached to the front body portion of the clothing portion such that they intersect each other or their extensions intersect each other. Therefore, as in the foregoing, even upon vigorous arm movements, the holding of bust is stable, and an excellent bust shaping function (bust uplifting function) can be exhibited.

BEST MODES FOR CARRYING OUT THE INVENTION

Figure 1C:
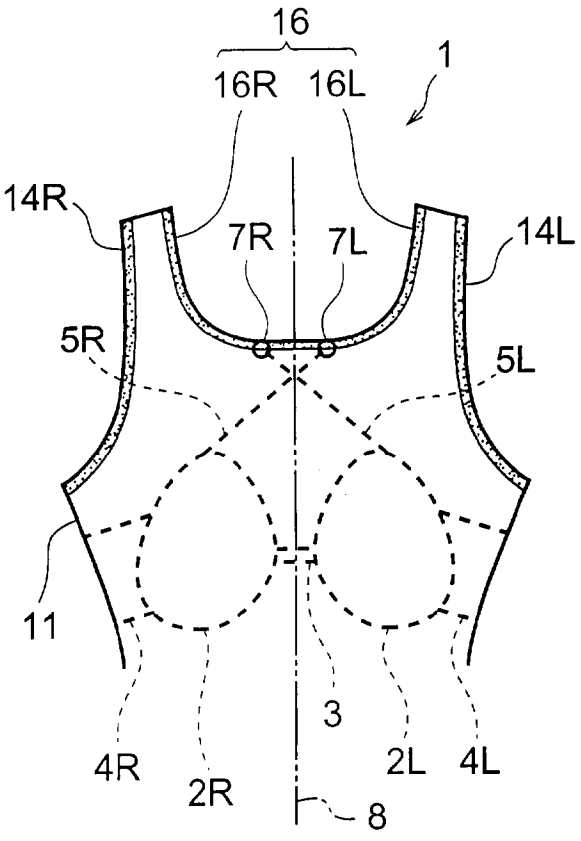
FIG. 1C is a front view of a sport clothing product with cups, showing an outline of a third embodiment.

In the following, swimsuits in accordance with first to third embodiments of the present invention will be explained with reference to the drawings. Among the drawings, constituents identical to each other are referred to with numerals identical to each other. The constituents referred to with numerals include those distinguished from each other in terms of left and right, such as left and right cup portions. These refer to the left and right as seen from the wearer. Therefore, in a view showing the wearer or swimsuits as seen from the front side, the right and left sides in the drawing become the left and right sides for the wearer, respectively.

OUTLINES OF FIRST TO THIRD EMBODIMENTS

Figure 1B:
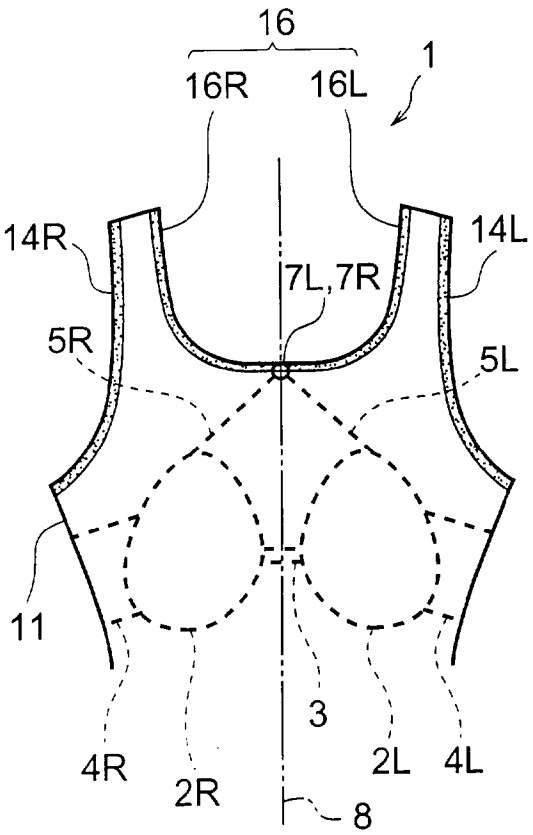
FIG. 1B is a front view of a sport clothing product with cups, showing an outline of a second embodiment.
Figure 1A:
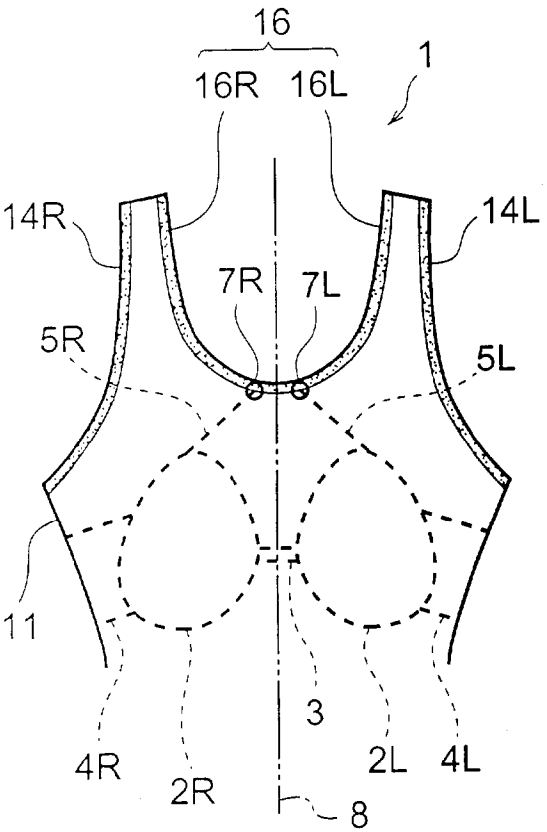
FIG. 1A is a front view of a sport clothing product with cups, showing an outline of a first embodiment.

To begin with, outlines of the individual embodiments will be explained with reference to FIGS. 1A, 1B, and 1C. FIGS. 1A, 1B, and 1C show the outlines of the first, second, and third embodiments, respectively. These drawings show swimsuits as seen from the front side.

The part indicated by the solid line shows a front body portion 11 of a clothing portion (body) 1. Formed in the right part of the clothing portion (body) 1 is a right arm hole hem part 14R, which is an example of a defining portion for defining a right armhole. Formed in the left part of the clothing portion (body) 1 is a left arm hole hem part 14L, which is an example of a defining portion for defining a left armhole. Formed in the upper part of the clothing portion 1 is a neck hole hem part 16, which is an example of a defining portion for defining a neck hole. The neck hole hem part 16 is constituted by a part 16R of the neck hole defining portion located on the right armhole side, and a part 16L of the neck hole defining portion located on the left armhole side.

The part indicated by dotted lines indicates a left cup portion 2L, a right cup portion 2R, a left cup suspending cord 5L, a right cup suspending cord 5R, a front center connecting portion 3, a right side cloth portion 4R, and a left side cloth portion 4L. The cup suspending cord is an example of cup suspending member. Numeral 8 indicates the front center line. The front center line 8 is a presumed (virtual) line, and does not exist in reality.

One end part of the right (left) cup suspending cord 5R (5L) is attached to the upper part of the right (left) cup portion 2R (2L). The other end part of the right (left) cup suspending cord 5R (5L) is attached to the neck hole hem part 16. These portions are referred to as an attachment portion 7R (7L).

The attaching position of the other end part of the right (left) cup suspending cord 5R (5L) varies among the first, second, and third embodiments. In the first embodiment shown in FIG. 1A, the other end part of the right (left) cup suspending cord 5R (5L) is positioned on the right (left) side of the front center line 8 in the vicinity of the front center line 8. In the second embodiment shown in FIG. 1B, the other end part of the right (left) cup suspending cord 5R (5L) is positioned on the front center line 8. In the third embodiment shown in FIG. 1C, the other end part of the right (left) cup suspending cord 5R (5L) is positioned on the left (right) side of the front center line 8.

The differences among the first, second, and third embodiments can also be expressed as follows. Namely, they are different from each other in the height of the neck hole hem part 16 and the attaching position of the right (left) cup suspending cord 5R (5L). In the case of FIG. 1A, the position of the neck hole hem part 16 is lower, whereby the right and left cup suspending cords 5R and 5L are attached to the neck hole hem part 16 before they intersect each other. In the case of FIG. 1B, the position of the neck hole hem part 16 is medium, whereby the right and left cup suspending cords 5R and 5L are attached to the neck hole hem part 16 at a position where they intersect each other. In the case of FIG. 1C, the position of the neck hole hem part 16 is higher, whereby the right and left cup suspending cords 5R and 5L are attached to the neck hole hem part 16 at a position higher than the position where they intersect each other.

Effects common in the first to third embodiments will be explained. In the first to third embodiments, the other end part of the right cup suspending cord 5R is attached to the neck hole hem part 16 such that the right cup portion 2R is pulled leftward when a pulling force acts on the left armhole hem part 14L and/or the part 16L of the neck hole hem part 16 located on the left armhole side. On the other hand, the other end part of the left cup suspending cord 5L is attached to the neck hole hem part 16 such that the left cup portion 2L is pulled rightward when a pulling force acts on the right armhole hem part 14R and/or the part 16R of the neck hole hem part 16 located on the right armhole side.

Therefore, the left cup portion 2L is lifted up by the left cup suspending cord 5L when the wearer raises the right arm, whereas the right cup portion 2R is lifted up by the right cup suspending cord 5R when the wearer raises the left arm. Thus, unlike conventional examples in which the right and left cup portions 2R and 2L are lifted up when the right and left arms are raised, respectively, movements of cup portions caused by vigorous arm movements are greatly alleviated, whereby stability improves.

The lifting directions of cup portions effected by the cup suspending cords when the wearer raises arms are such that the right cup portion 2R is lifted in the upper left direction when the left arm is raised, and the left cup portion 2L is lifted in the upper right direction when the right arm is raised. Thus, unlike conventional examples in which the right and left cup portions 2R and 2L are lifted in the upward direction when the right and left arms are raised, respectively, they are lifted up in so-called "centering" directions. Therefore, an excellent shaping function of beautifully centering/uplifting the bust even at the time of exercising can be exhibited.

The effects of this embodiment can also be explained as follows. The other end part of the right cup suspending cord 5R and the other end part of the left cup suspending cord 5L are attached to the neck hole hem part 16 such that the cup suspending cords intersect each other (see FIGS. 1B and 1C) or their respective extensions intersect each other in the vicinity of the front neck point (see FIG. 1A). Therefore, as in the foregoing, the stability in the holding of bust and the excellent bust shaping function are obtained.

First Embodiment

The swimsuit in accordance with the first embodiment will now be explained in detail. In the first embodiment, as shown in FIG. 1A, the other end part of the right (left) cup suspending cord 5R (5L) is attached to the neck hole hem part 16 at the attachment portion 7R (7L). The attachment portion 7R (7L) is positioned on the right (left) side of the front center line 8 in the vicinity of the front center line 8. In other words, the right (left) cup suspending cord 5R (5L) extends in the upper left (right) direction, whereas their end parts are attached to the neck hole hem part 16 at a position in front of the position where the cup suspending cords intersect each other.

Figure 2:
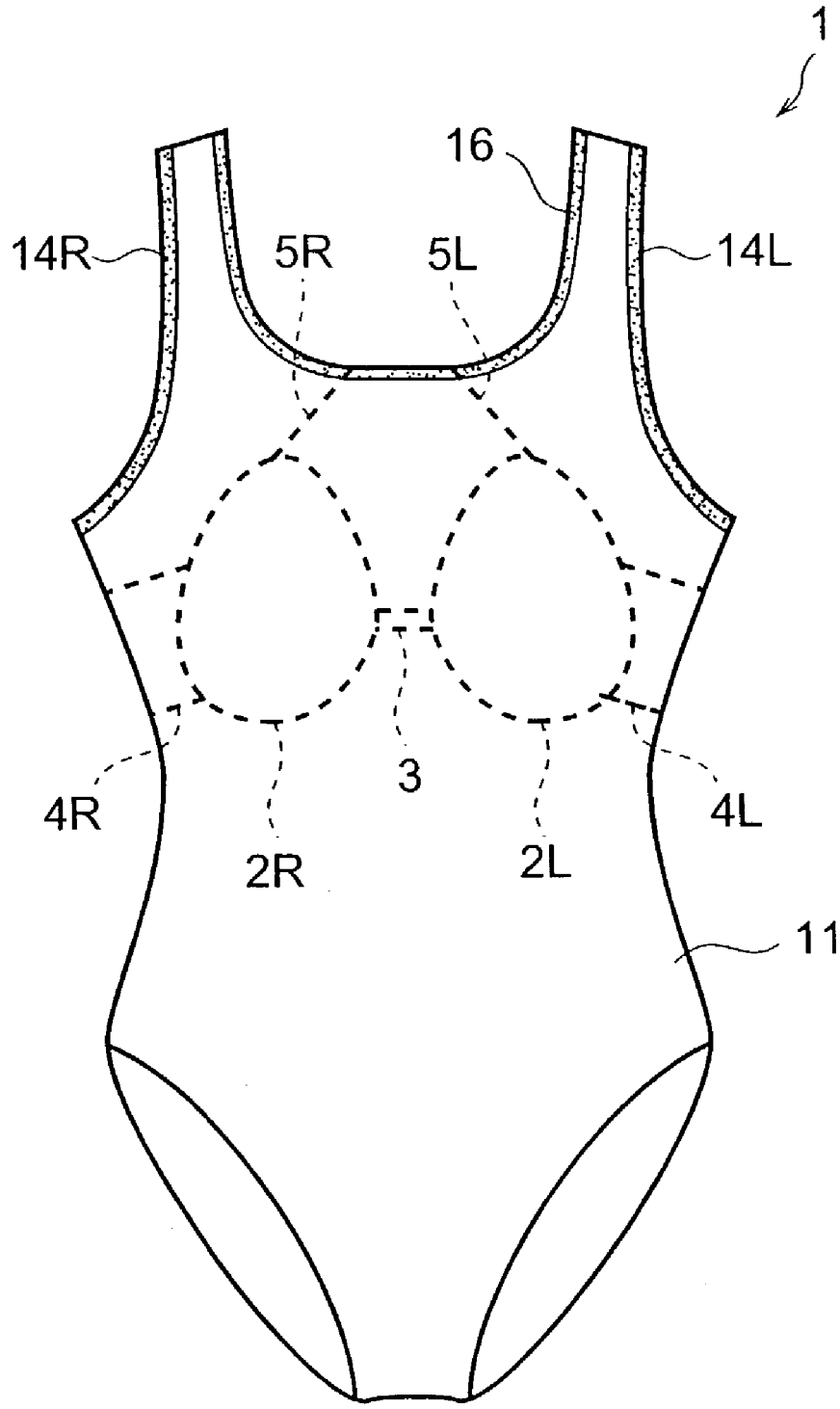
FIG. 2 is a front view of a swimsuit in accordance with a first type of the first embodiment.
Figure 3A:
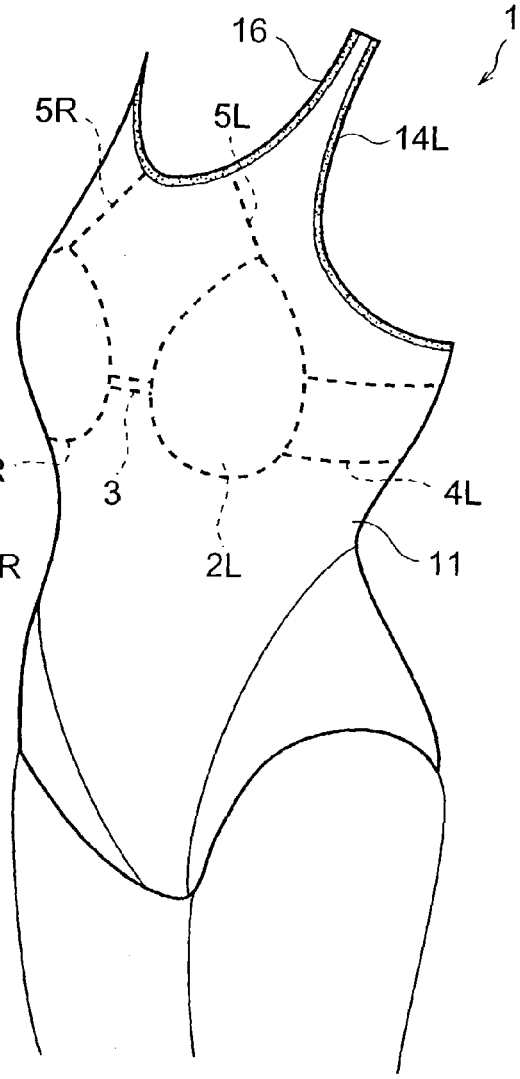
FIG. 3A is a perspective view of a worn state of the swimsuit shown in FIG. 2.
Figure 3B:
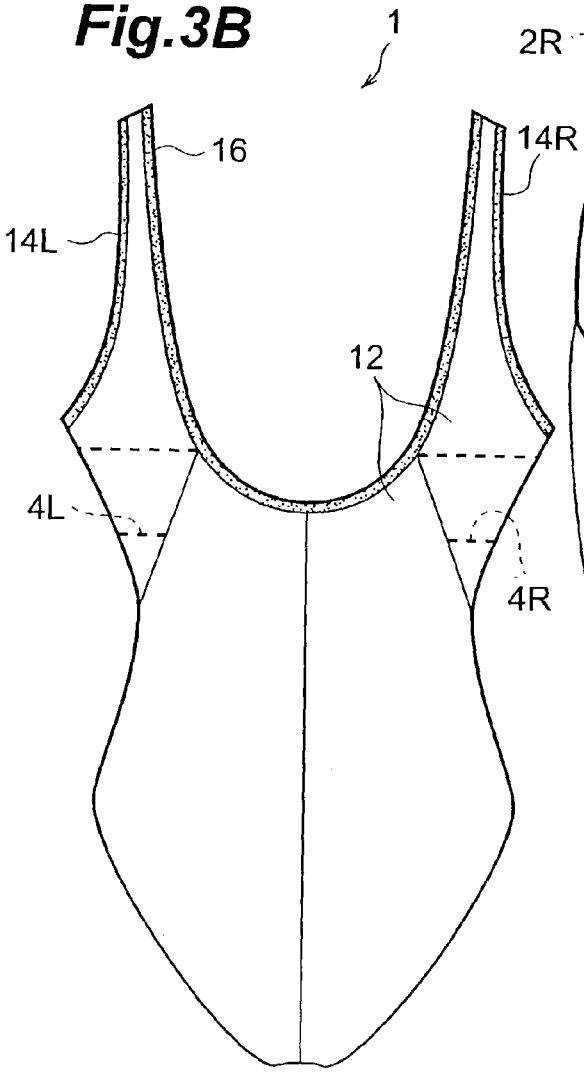
FIG. 3B is a rear view of the swimsuit shown in FIG. 2.

As shown in FIGS. 2 and 4 to 11, the first embodiment includes various types. To begin with, a first type of the first embodiment will be explained with reference to FIGS. 2, 3A, and 3B. FIG. 2 is a front view of a swimsuit, omitting joint lines; FIG. 3A is a perspective view of the swimsuit in a worn state; and FIG. 3B is a rear view of the swimsuit. A clothing portion 1 covering a human body (mainly a torso) is constituted by a front body portion 11 covering the front side of the human body, and a back section 12 covering the back side of the human body. The front body portion 11 and the back section 12 are sewn together by joint lines at positions such as side portions. The front body portion 11 and the back section 12 come into close contact with the human body when worn. As materials for the front body portion 11 and back section 12, those excellent in contraction and expansion properties and resistance to water, for example, such as polyurethane, polyester, nylon, and acrylics are used.

The right (left) armhole of the clothing portion 1 is a hole for passing an arm therethrough, whereas a tape having contraction and expansion properties and elasticity is attached to a right (left) armhole hem part 14R (14L) which is a hem part of the armhole. The neck hole of the clothing portion 1 is a hole for passing a head therethrough, whereas a tape having contraction and expansion properties and elasticity is also attached to a neck hole hem part 16 which is a hem part of the neck hole. Examples of the tapes attached to these hem parts include polyurethane type flat tapes and latex type flat tapes, whereas braided elastics, knit elastics, woven elastics, and various kinds of stretch tapes can also be used.

In the case of swimsuits, it is desirable that the neck hole hem part 16 be stronger than the right (left) armhole hem part 14R (14L). Therefore, when a well-expanding latex type flat tape is used for the right (left) armhole hem part 14R (14L), a strong polyurethane type flat tape can be used for the neck hole hem part 14R (14L). However, the expansion and contraction properties and the degree of elasticity vary depending on the width, thickness, and weaving methods even among tapes made of the same material. Hence, tapes made of the same material can be used for the hem parts 14R, 14L, and 16.

As illustrated by dotted lines, a pair of right and left cup portions 2R and 2L are disposed on the inside of the front body portion 11. The right (left) cup portion 2R (2L) is formed from nonwoven, polyurethane, or the like into a shape which fits the bust. The right (left) cup portion 2R (2L) is often formed by sticking a plurality of kinds of cloth materials together.

The end part of the right cup portion 2R on the front center side and the end part of the left cup portion 2L on the front center side are connected to each other by a tape-like front center connecting portion 3. The front center connecting portion 3 is constituted, for example, by a tape material which does not stretch or contract (e.g., a woven tape including no elastic threads, or a cotton tape), a tape material which has a small amount of elastic threads and is adapted to stretch less, a knitted or woven article of amorphous resin fibers, or a tape material, having contraction and expansion properties, impregnated with a resin.

Sewn to the side end part of the right (left) cup portion 2R (2L) is one end part of a right (left) side cloth portion 4R (4L) having a width greater than that of the front center connecting portion 3. The other end part of the right (left) side cloth portion 4R (4L) is sewn to the clothing portion 1 by the joint line in the back section 12 as shown in FIG. 3B.

As a material for the right (left) side cloth portion 4R (4L) having a predetermined width, warp knitted fabrics such as power net, tricot, and triconet can be used, for example. Also, one having a smaller width such as a flat tape can be used. The "predetermined width" of the right (left) side cloth portion 4R (4L) may be about 8 cm, for example, and is 3 to 9 cm in a standard size. The right (left) side cloth portion 4R (4L) is formed from a material having contraction and expansion properties in view of its movement traceability and size adaptability. It preferably includes elastic threads, and a gradation hem power net is preferable, for example. This is a kind of power net in which both end parts use a hem requiring no sewing. Differences in strength of the power can partly be provided when the number and thickness of elastic threads incorporated in the power net are changed or when the knitting pattern is altered. In this embodiment, the power is strengthened at both upper and lower end parts and is weakened therebetween (in the intermediate part) in the worn state. Alternatively, the power may be strengthened in the intermediate portion and is made weaker in both upper and lower end parts than in the intermediate part. Though the power net is explained in the foregoing, the same holds for tricot and triconet.

Sewn to the upper end part of the right (left) cup portion 2R (2L) is one end part of the right (left) cup suspending cord 5R (5L). Sewn to the neck hole hem part 16 in the front body portion 11 is the other end part of the right (left) cup suspending cord 5R (5L). The cup suspending cord is an example of the cup suspending tape member.

As for the right (left) cup suspending cord 5R (5L), a braided elastic adapted to contract and stretch is preferable, whereas knit elastics, woven elastics, and various kinds of stretch tapes can also be used. Though a material adapted to contract and stretch is preferable in view of movement traceability, no contraction and expansion properties are necessary when the upper end of the right (left) cup portion 2R (2L) and the neck hole hem part 16 are located close to each other. The degree of contraction and expansion properties can freely be set by changing the kind, thickness, number, knitting pattern, or weaving pattern of elastic threads included in the tape material. For example, different kinds of tapes may be connected together in the longitudinal direction or the knitting pattern may be altered in the middle of a single tape, so as to provide differences in strength of the power. This can lower the expansion of the part sewn to the right (left) cup portion 2R (2L), and enhance the expansion of the part extending from the right (left) cup portion 2R (2L) to the neck hole hem part 16. Similar effects can be also be obtained when the same kind of tapes having different thicknesses and widths are used in place of different kinds of tapes.

When the wearer raises the right arm in the case where the right (left) cup suspending cord 5R (5L) has high contraction and expansion properties, the left cup suspending cord 5L disposed so as to extend substantially along the direction in which the right arm is raised pulls up the left cup portion 2L while expanding. When the wearer raises the left arm, the right cup suspending cord 5R disposed so as to extend substantially along the direction in which the left arm is raised pulls up the right cup portion 2R while expanding. As a consequence, even upon vigorous arm movements, the holding of bust becomes stable, and the bust shaping (bust uplifting) function can be exhibited.

On the other hand, an end part of the right (left) side cloth portion 4R (4L) adapted to contract and stretch is sewn to the clothing portion 1. Therefore, when the left arm is raised, the right cup suspending cord 5R and the right side cloth portion 4R pull each other with the right cup portion 2R disposed therebetween while expanding. When the right arm is raised, the left cup suspending cord 5L and the left side cloth portion 4L pull each other with the left cup portion 2L disposed therebetween while expanding. As a result, parts on the underside become stable even at the time of exercising, whereby the stability of bust further improves.

Figure 4:
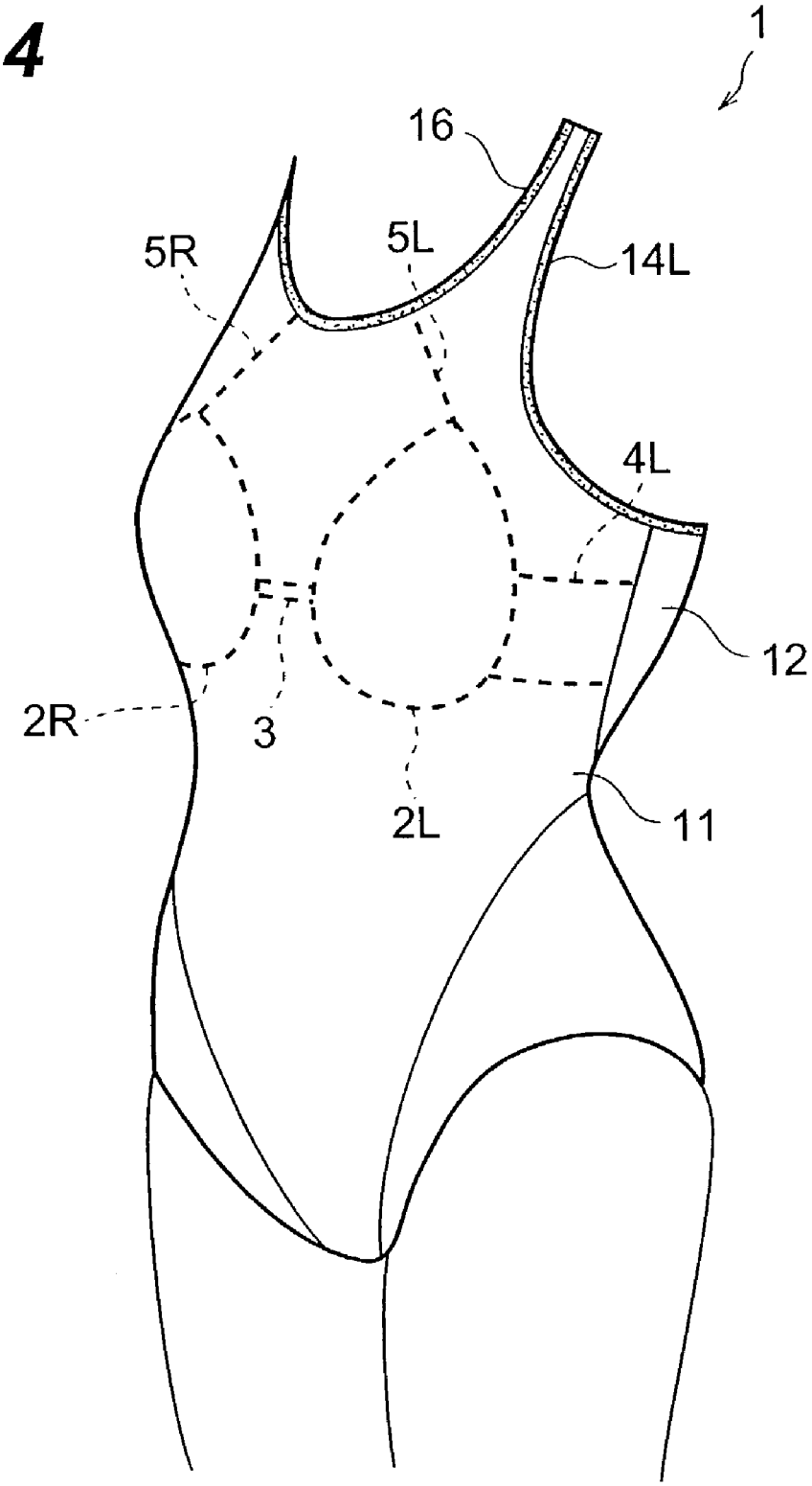
FIG. 4 is a perspective view of a swimsuit in a worn state, showing a second type of the first embodiment.

As for other types of the first embodiment, differences from the first type will now be explained. FIG. 4 is a perspective view of a swimsuit in a worn state, showing a second type of the first embodiment. Here, the other end part of the right (left) side cloth portion 4R (4L) is sewn to a joint part between the front body portion 11 and the back section 12.

Figure 5:
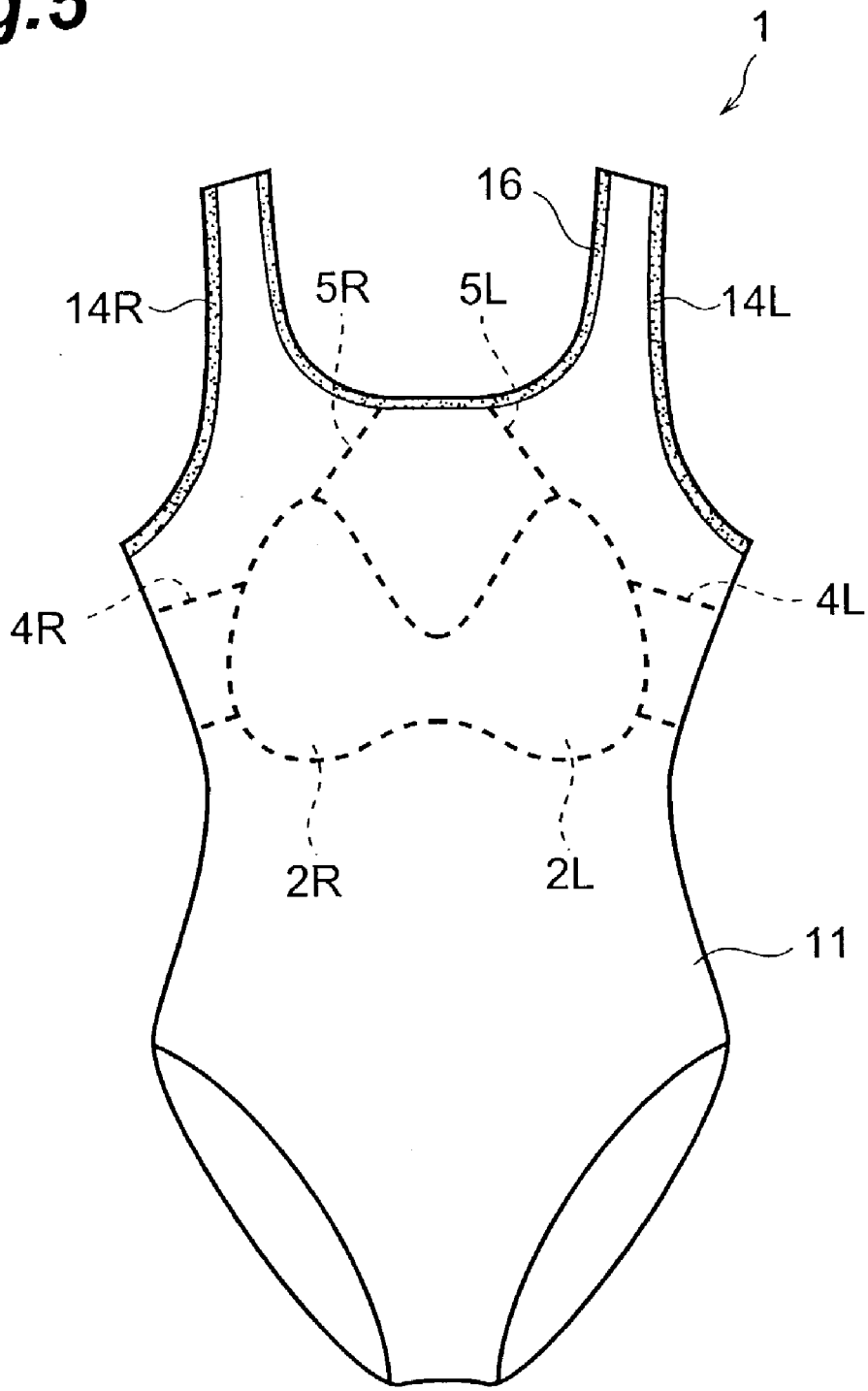
FIG. 5 is a front view of a swimsuit, showing a third type of the first embodiment.

FIG. 5 is a front view of a swimsuit, showing a third type of the first embodiment. In the third type, the right cup portion 2R and the left cup portion 2L are integrated together at the front center part.

Figure 6:
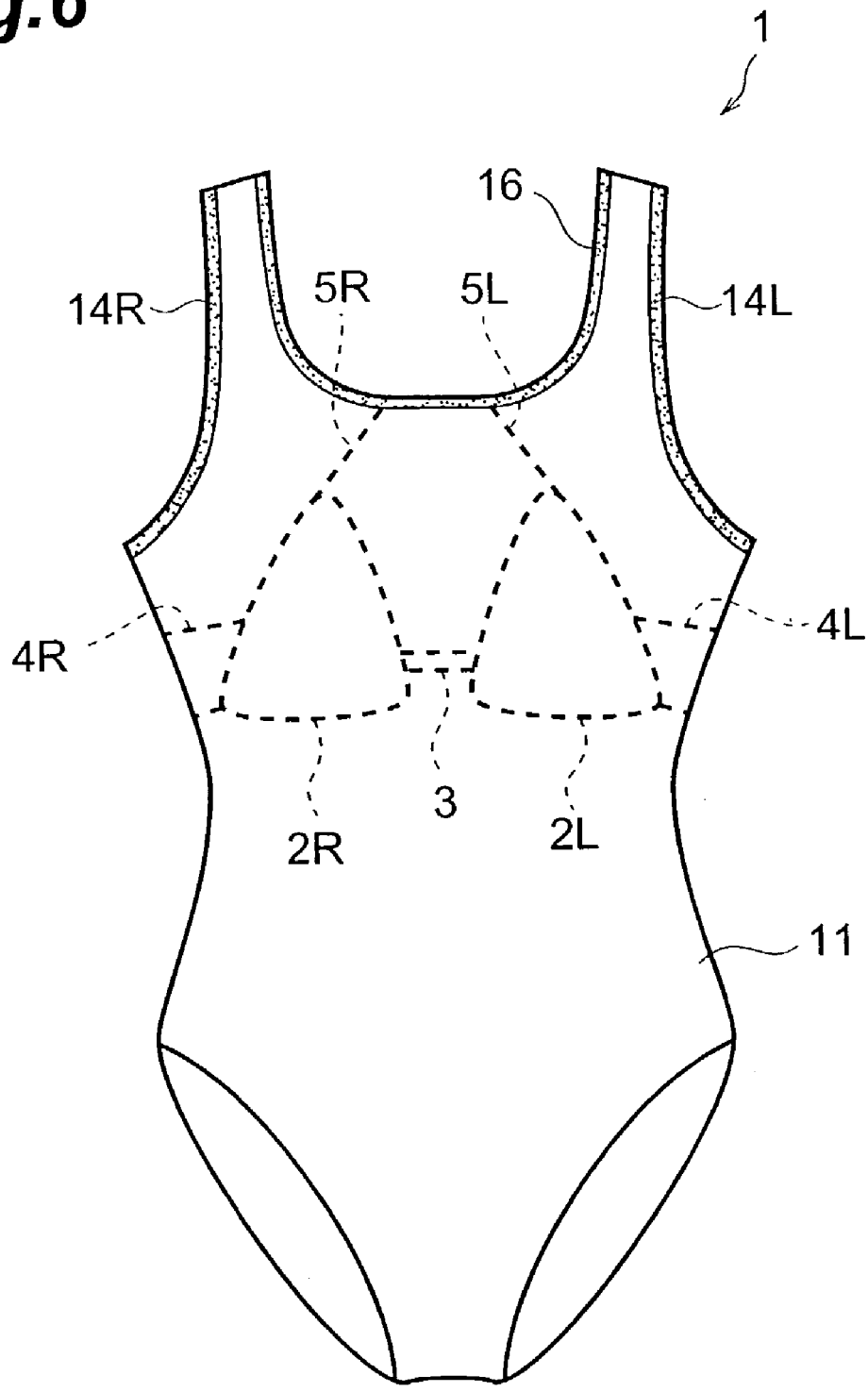
FIG. 6 is a front view of a swimsuit, showing a fourth type of the first embodiment.

FIG. 6 is a front view of a swimsuit, showing a fourth type of the first embodiment. In the fourth type, each of the right cup portion 2R and the left cup portion 2L has a triangular form.

Figure 7:
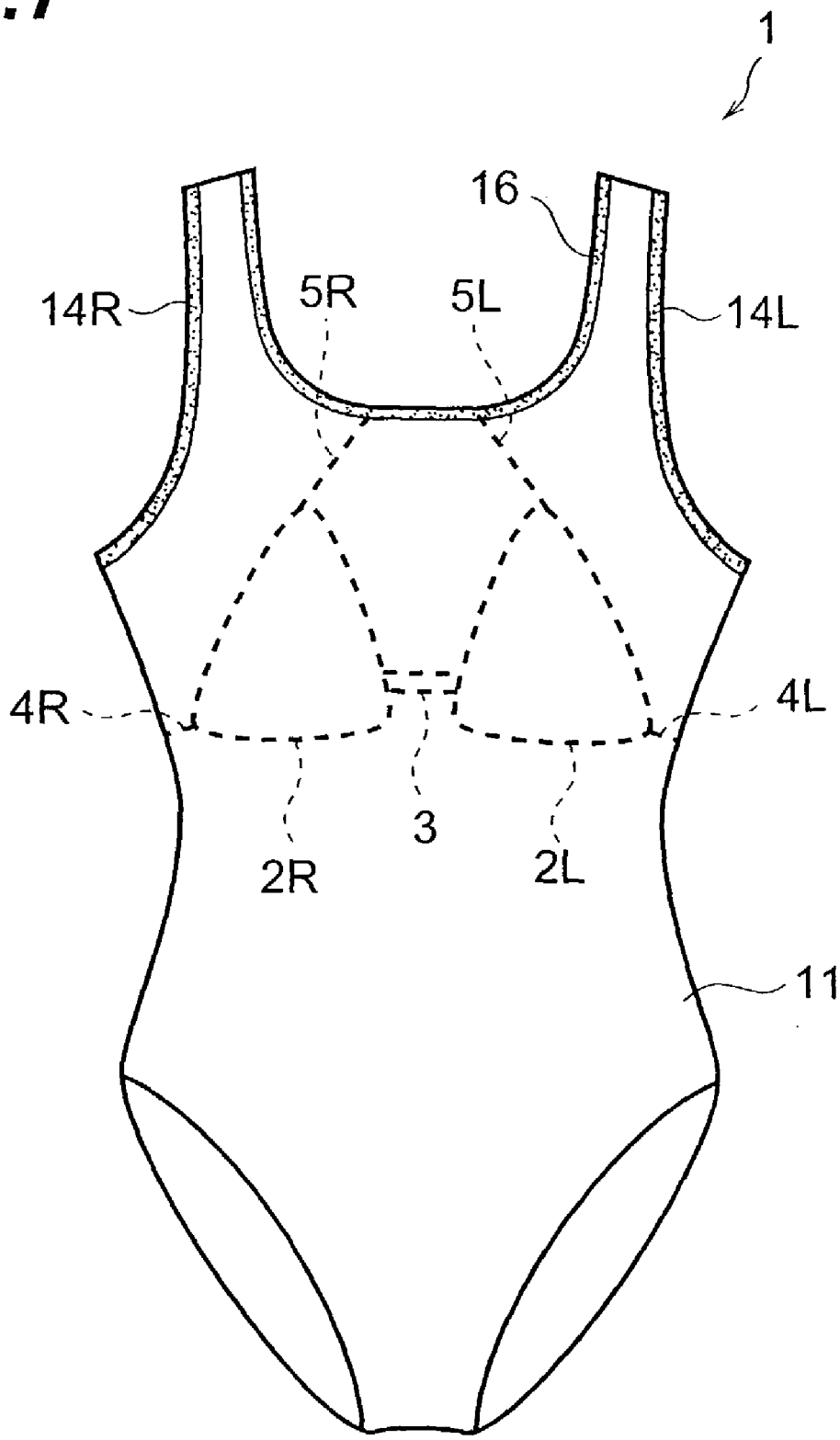
FIG. 7 is a front view of a swimsuit, showing a fifth type of the first embodiment.

FIG. 7 is a front view of a swimsuit, showing a fifth type of the first embodiment. The fifth type differs from the fourth type shown in FIG. 6 in that the right (left) side cloth portion 4R (4L) is shaped like a thin cord.

Figure 8:
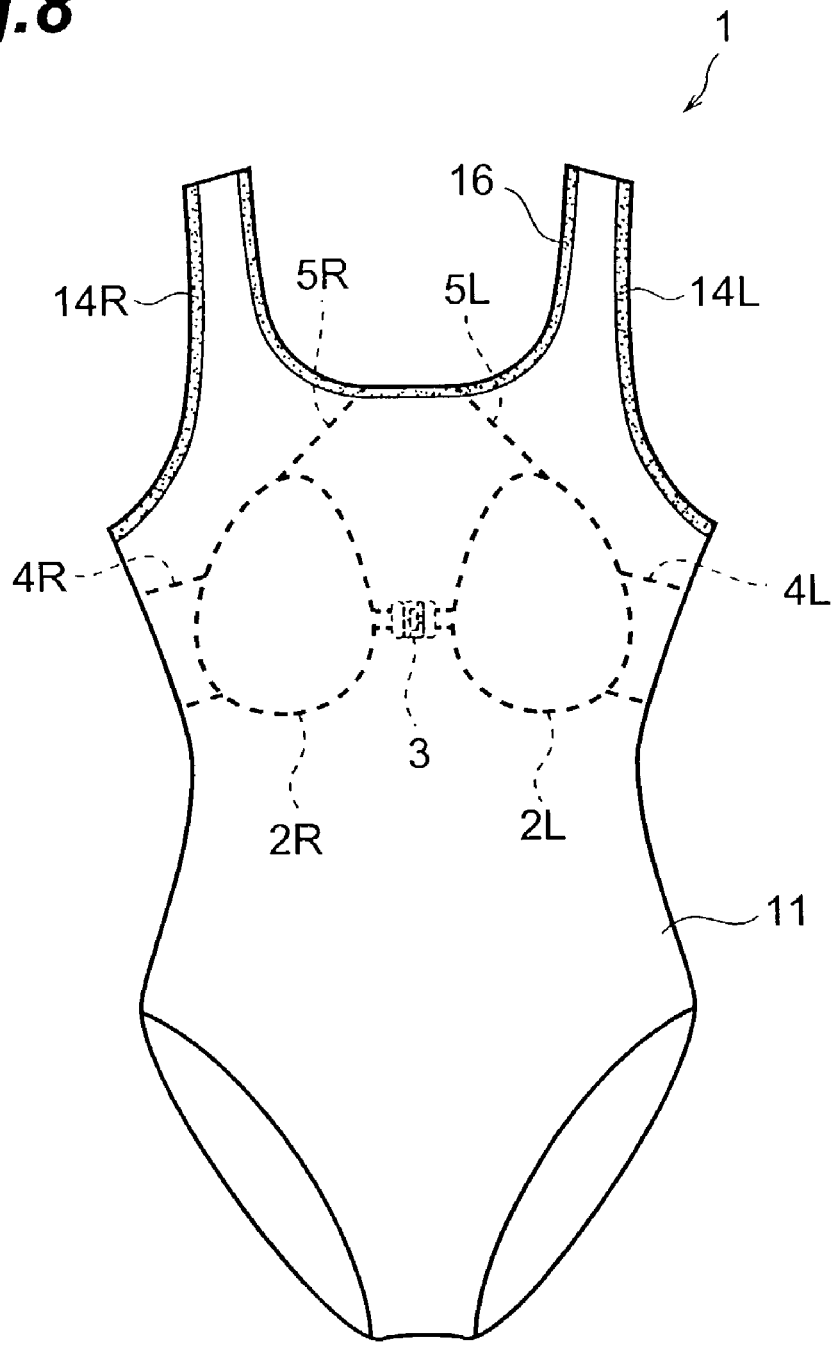
FIG. 8 is a front view of a swimsuit, showing a sixth type of the first embodiment.

FIG. 8 is a front view of a swimsuit, showing a sixth type of the first embodiment. In the sixth type, the front center connecting part 3 includes a hook which is an example of connecting means. This makes it possible for the right cup portion 2R and the left cup portion 2L to connect with each other and separate from each other at the front center. As the hook, known hooks made of plastics and metals can be used. According to this configuration, the bust can easily fit into the right (left) cup portion 2R (2L).

Figure 9:
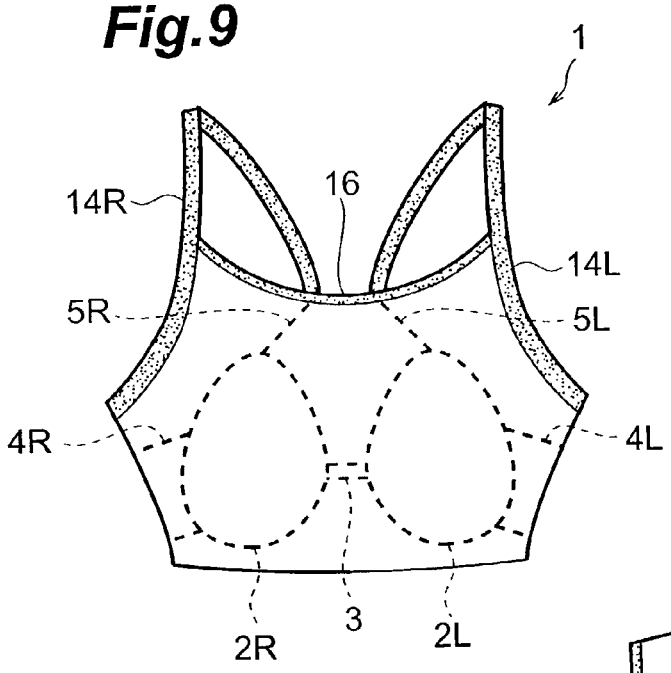
FIG. 9 is a front view of a swimsuit, showing a seventh type of the first embodiment.

FIG. 9 is a front view of a swimsuit, showing a seventh type of the first embodiment. Though the seventh type is a so-called separate type, the configuration of its bust portion is similar to that in FIG. 2.

Figure 10:
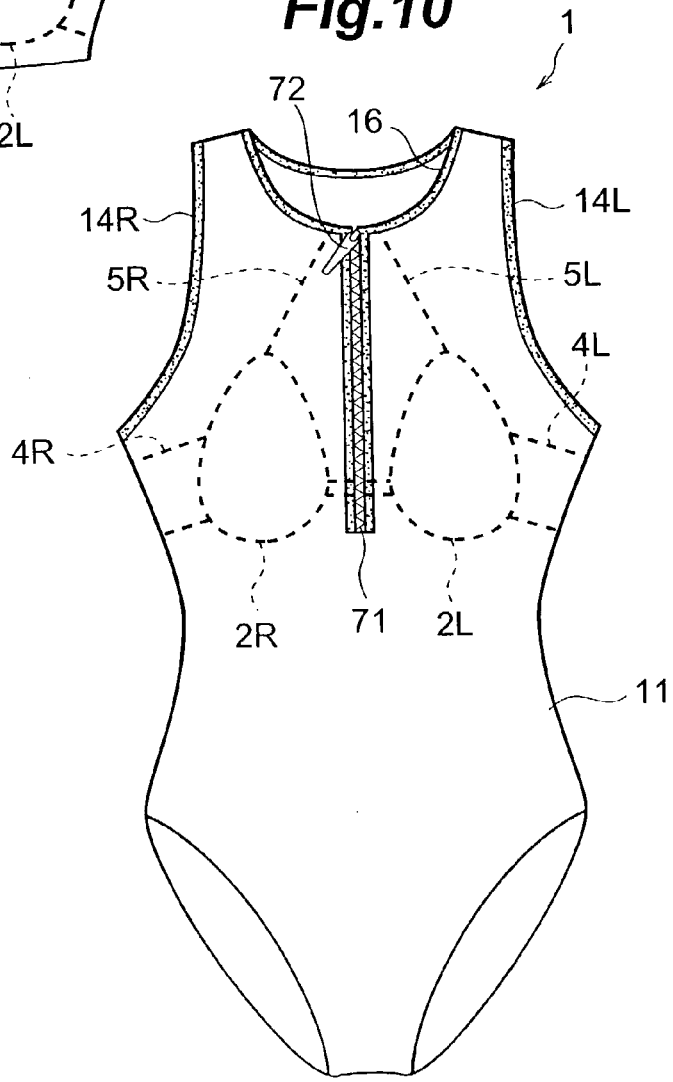
FIG. 10 is a front view of a swimsuit, showing an eighth type of the first embodiment.

FIG. 10 is a front view of a swimsuit, showing an eighth type of the first embodiment. In the eighth type, the front center side of the right (left) cup portion 2R (2L) is sewn to the front body portion 11. The front body portion 11 is divided into left and right portions at the front center thereof from the neck hole hem part 16 to the lower part of the front center. The divided part is configured so as to be freely opened and closed by a fastener constituted by fastener teeth 71 and a slider 72. According to the eighth type, it becomes easier to wear the swimsuit with cups itself, and the bust can easily fit into the right (left) cup portion 2R (2L).

Figure 11:
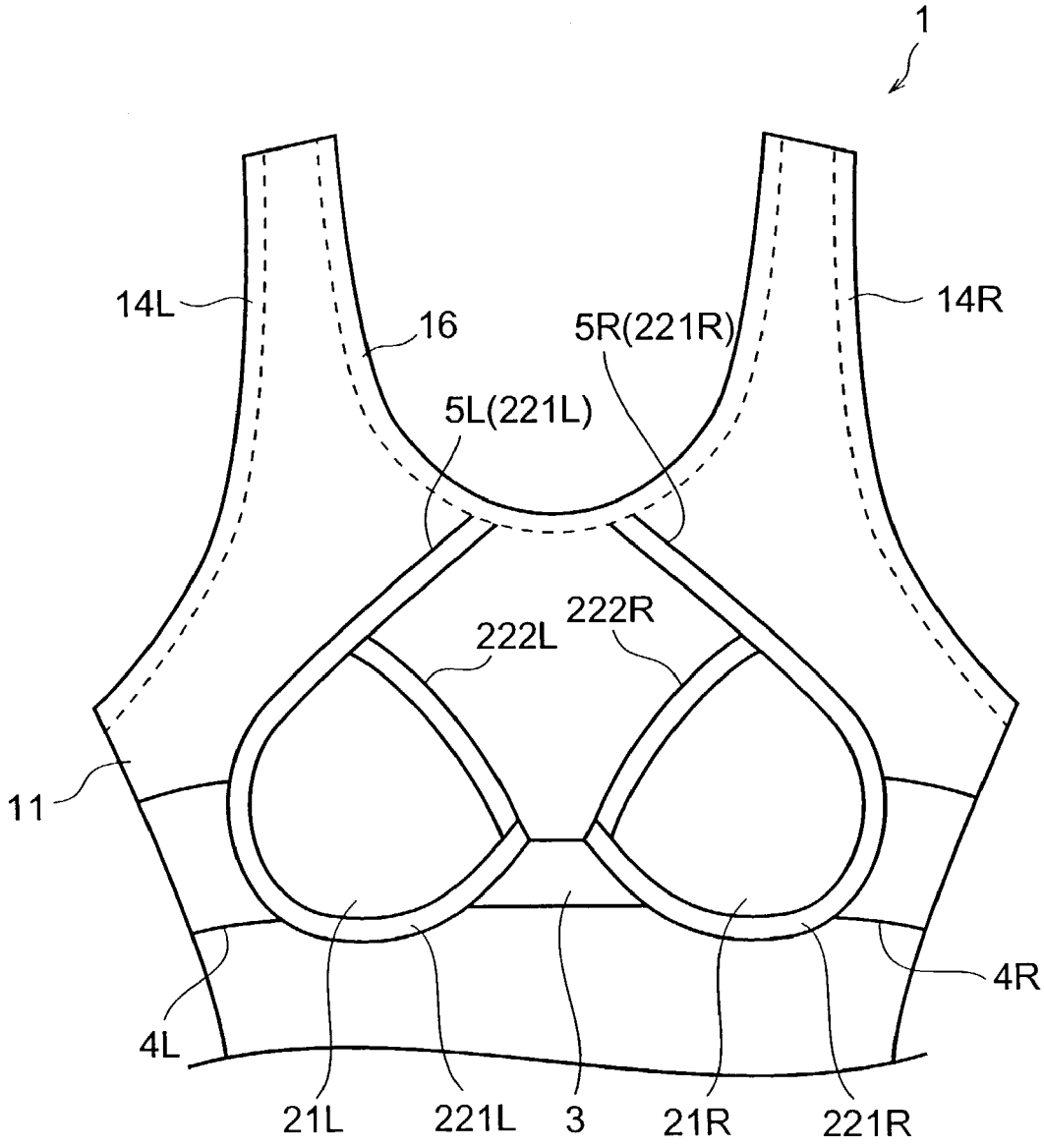
FIG. 11 is a rear view of the front face of a swimsuit, showing a ninth type of the first embodiment.

FIG. 11 is a rear view of the front face of a swimsuit, showing a ninth type of the first embodiment. Since it is the rear view of the front face of the swimsuit, the left and right in the drawings coincide with those of the wearer, respectively. In the ninth type, a part of the right (left) cup suspending cord 5R (5L) is a part of the constituents of the right (left) cup portion 2R (2L). This will be explained in detail in the following.

In a right (left) cup member 21R constituting the main body of the right (left) cup portion 2R (2L), the rim part of its side portion from the upper end part to the lower end part has a smoothly bending arc form. The upper part of the right (left) cup portion 21R (21L) on the front center side has a substantially linear form. A tape material 221R (221L) attached so as to extend along the arc-like rim part is smoothly drawn from the upper end part of the right (left) cup member 21R (21L) toward the vicinity of the neck point of the wearer in the worn state, whereas its front end part is sewn to the neck hole hem part 16 of the front body portion 11 of the clothing portion 1. As a consequence, in the tape material 221R (221L) attached so as to extend along the arc-shaped rim part, the part smoothly drawn from the upper end part of the right (left) cup member 21R (21L) toward the vicinity of the neck point functions as the right (left) cup suspending cord 5R (5L) adapted to contract and stretch.

While the upper part of the right (left) cup member 21R (21L) on the front center side has a substantially linear form, another tape material 222R (222L) is sewn to this rim part. The right and left cup portions 2R and 2L are connected to each other at the front center with the front center connecting portion 3 made of a tape cloth material having no contraction and expansion properties (or low contraction and expansion properties). Sewn to the side part of the right (left) cup portion 2R (2L) is one end part of the right (left) side cloth portion 4R (4L). The other end part of the right (left) side cloth portion 4R (4L) is sewn to the front body portion 11. The right (left) side cloth portion 4R (4L) is made of a wide cloth material adapted to contract and stretch.

Thus, according to the ninth type shown in FIG. 11, the tape materials 221R and 221L are smoothly drawn in their intersecting direction without being bent at the upper end part of the right (left) cup member 21R (21L), whereby the stability in the movement of the right (left) cup portion 2R (2L) is further enhanced.

Second Embodiment

Concerning the swimsuit with cups in accordance with the second embodiment, differences from the first embodiment will now be explained. In the second embodiment, as shown in FIG. 1B, the other end part of the right (left) cup suspending cord 5R (5L) is positioned on the front center line 8. In other words, the other end parts of the right and left cup suspending cords 5R and 5L are attached to the front body portion 11 at the same position. In still other words, at the position where the right and left cup suspending cords 5R and 5L intersect each other, their end parts are attached to the neck hole hem part 16.

Figure 12:
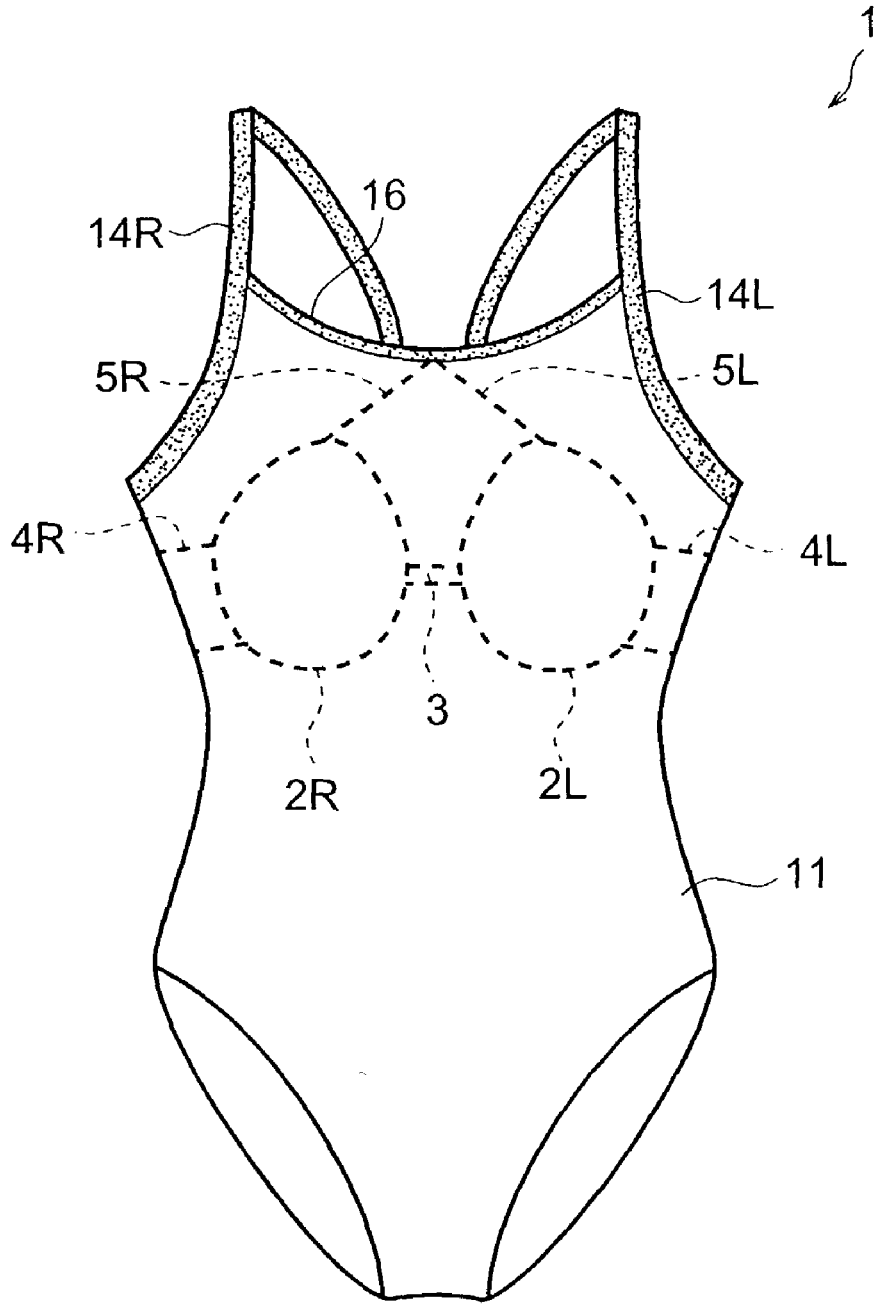
FIG. 12 is a front view of a swimsuit, showing a first type of the second embodiment.
Figure 13A:
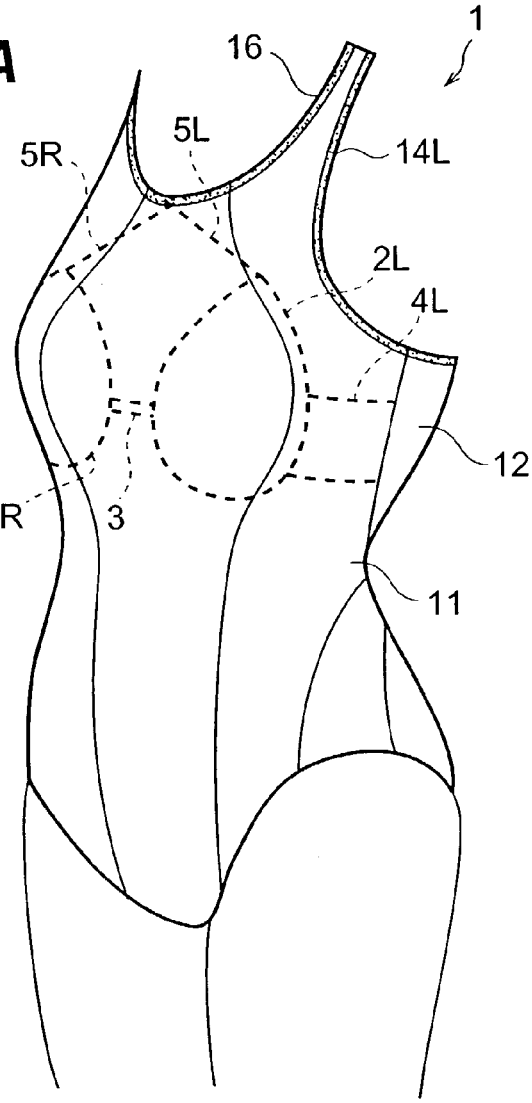
FIG. 13A is a perspective view of a swimsuit in a worn state, showing a second type of the second embodiment.
Figure 13B:
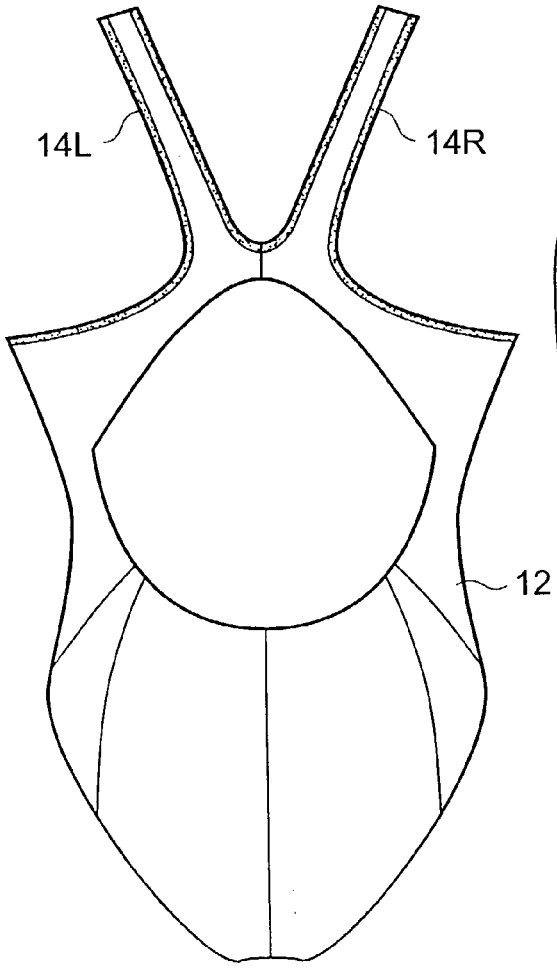
FIG. 13B is a rear view of the swimsuit shown in FIG. 13A.
Figure 14A:
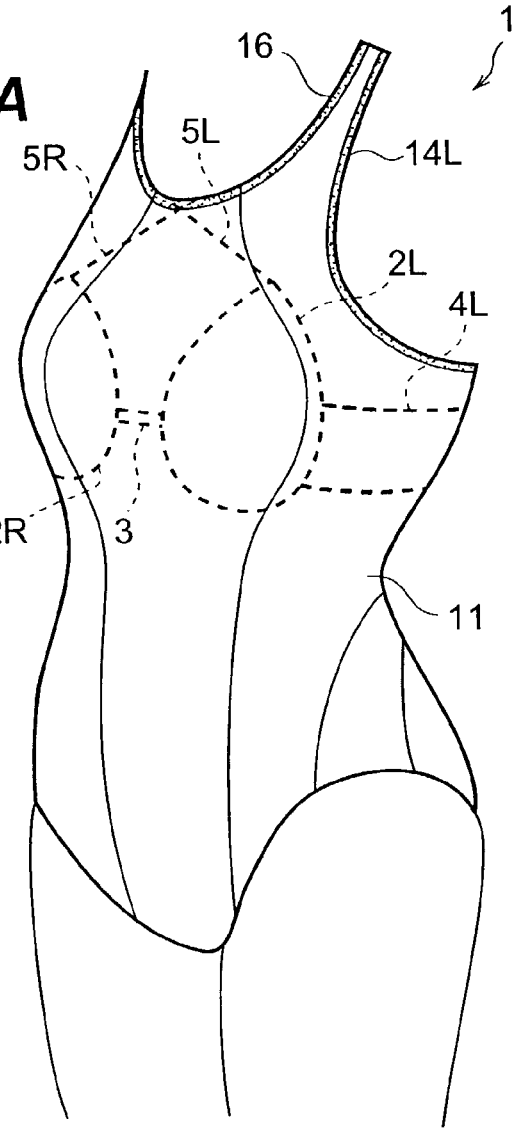
FIG. 14A is a perspective view of a swimsuit in a worn state, showing a third type of the second embodiment.
Figure 14B:
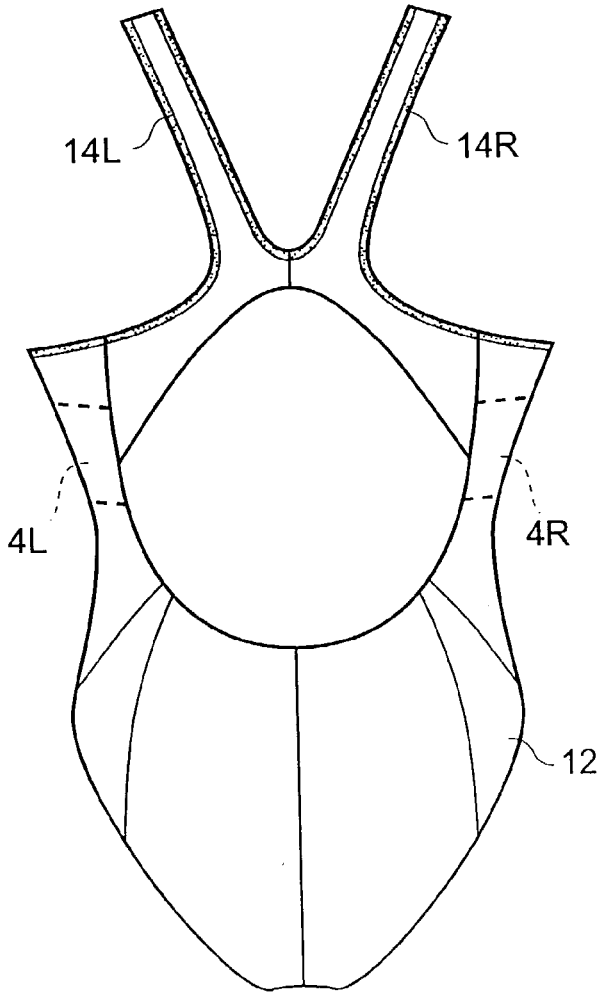
FIG. 14B is a rear view of the swimsuit shown in FIG. 14A.

The second embodiment includes various types as shown in FIGS. 12, 13A, and 14A. FIG. 12 is a front view of a swimsuit, showing a first type of the second embodiment. FIG. 13A is a perspective view of a swimsuit in a worn state, showing a second type of the second embodiment. FIG. 13B is a rear view of the swimsuit, showing the second type of the second embodiment. FIG. 14A is a perspective view of a swimsuit in a worn state, showing a third type of the second embodiment. FIG. 14B is a rear view of the swimsuit, showing the third type of the second embodiment. The third type differs from the second type in terms of the attaching position of the right (left) side cloth portion 4R (4L). In the first to third types of the second embodiment, materials for the right (left) cup portion 2R (2L) and the like are similar to those in the first embodiment.

Third Embodiment

Concerning the swimsuit with cups in accordance with the third embodiment, differences from the first embodiment will be explained. In the third embodiment, as shown in FIG. 1C, the other end part of the right (left) cup suspending cord 5R (5L) is positioned on the left (right) side of the front center line 8. In other words, at a position higher than the position where the right and left cup suspending cords 5R and 5L intersect each other, their end parts are attached to the neck hole hem part 16.

Figure 15:
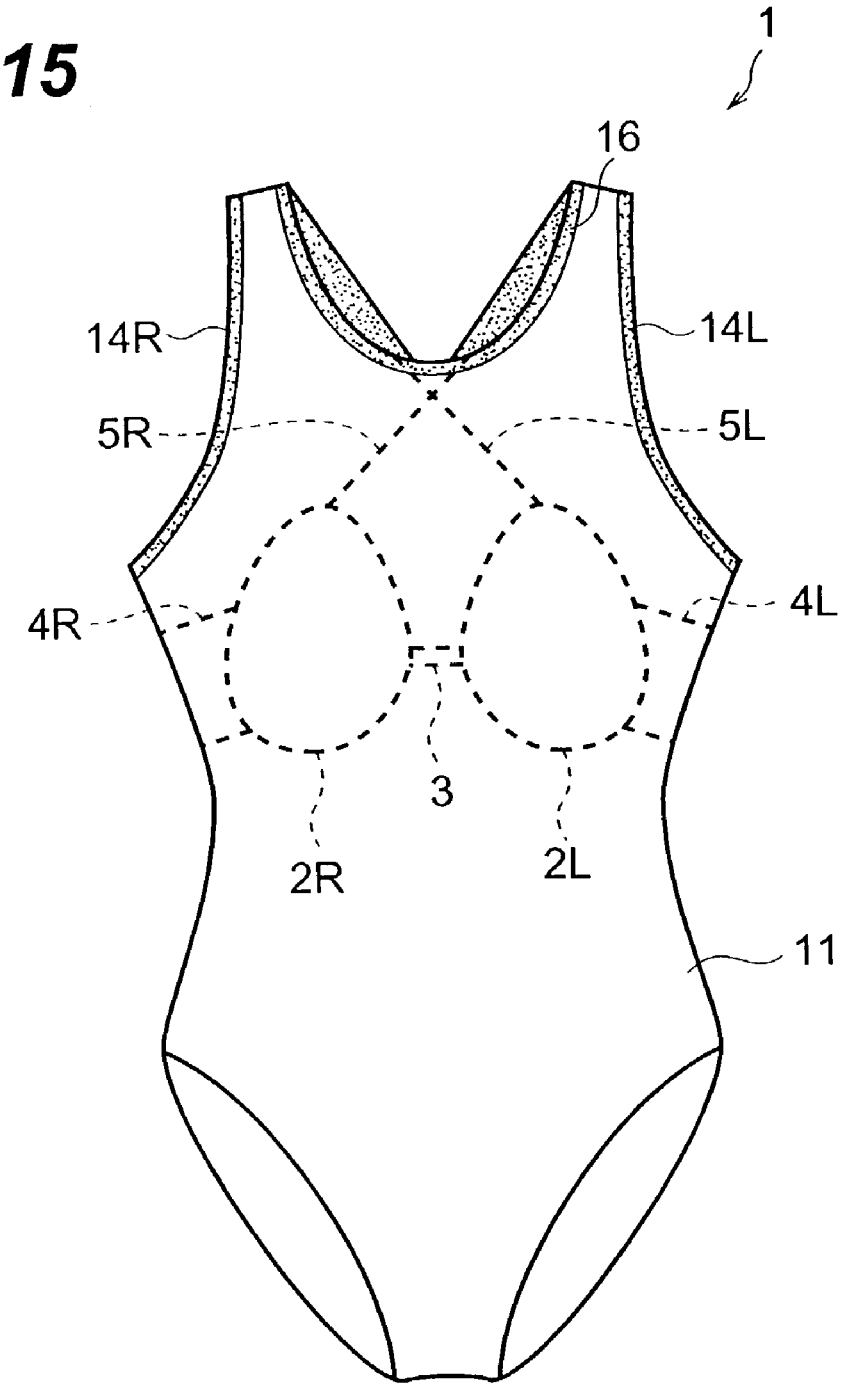
FIG. 15 is a front view of a swimsuit, showing a first type of the third embodiment.
Figure 16:
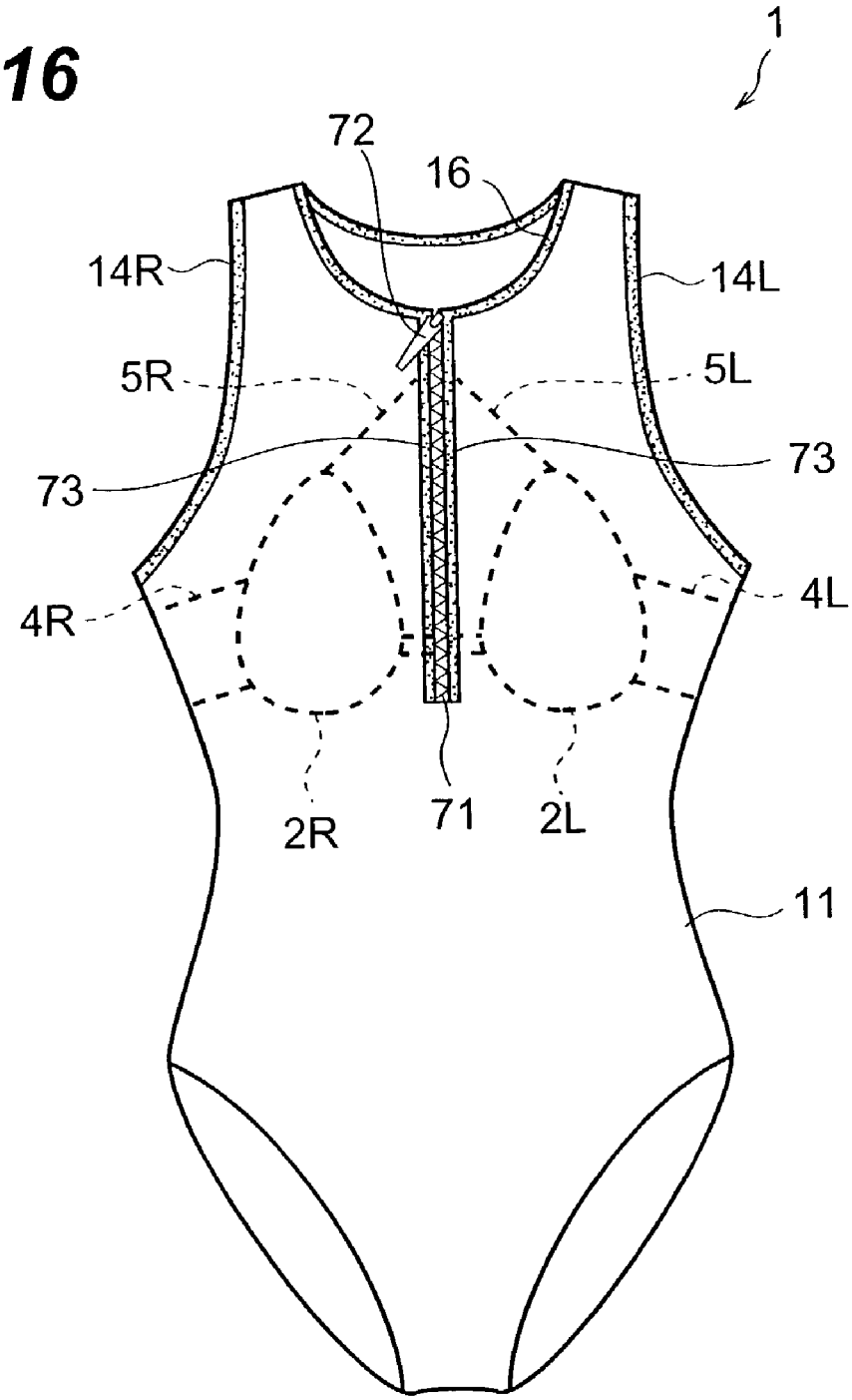
FIG. 16 is a front view of a swimsuit, showing a second type of the third embodiment.

The third embodiment includes various types as shown in FIGS. 15 and 16. FIG. 15 is a front view of a swimsuit, showing a first type of the third embodiment. FIG. 16 is a front view of a swimsuit, showing a second type of the third embodiment. The second type shown in FIG. 16 is configured so as to be freely opened and closed by fastener means constituted by fastener teeth 71 and a slider 72 as in the first embodiment shown in FIG. 10. The end part of the right (left) cup suspending cord 5R (5L) is sewn to a fastener tape 73 to which the fastener teeth 71 are attached. In the second type shown in FIG. 16, the right cup suspending cord 5R and the left cup suspending cord 5L extend in the upper left and upper right directions, respectively, and are equivalent to those in a case where they intersect each other at a position in front of the neck hole hem part 16 and then are attached to the front body portion 11 (the fastener tape 73 sewn to the front body portion 11). In the first and second types of the third embodiment, materials for the right (left) cup portion 2R (2L) and the like are similar to those in the first embodiment.

MODIFIED EXAMPLES

Modified examples of the first to third embodiments will now be explained. For example, in the first to third embodiments, the upper end part (the other end part) of the right (left) cup suspending cord 5R (5L) is sewn to the neck hole hem part 16 of the front body portion 11. However, an adjuster (an example of connecting means) such as one in Japanese Utility Model Application Laid-Open No. SHO 60-67313 may be provided such that the upper end part of the right (left) cup suspending cord 5R (5L) can be attached to and removed from the front body portion 11. Alternatively, the lower end part (one end part) of the right (left) cup suspending cord 5R (5L) may be made attachable to and removable from the upper edge part of the right (left) cup portion 2R (2L).

Such modified examples will be explained with reference to FIGS. 17A, 17B, and 18 to 21. First, constituents common among FIGS. 17A, 17B, and 18 to 21 will be explained. The right (left) cup portion 2R (2L) has a lower tape member 23 at the lower edge part thereof, and an upper tape member 24R (24L) at the upper edge part thereof. Both side ends of the lower tape member 23 are attached to the front body portion 11 in the right (left) side cloth portion 4R (4L) The upper end part of the upper tape material 24R (24L) is attached to the neck hole hem part 16 by the right (left) cup suspending cord 5R (5L).

Figure 17A:
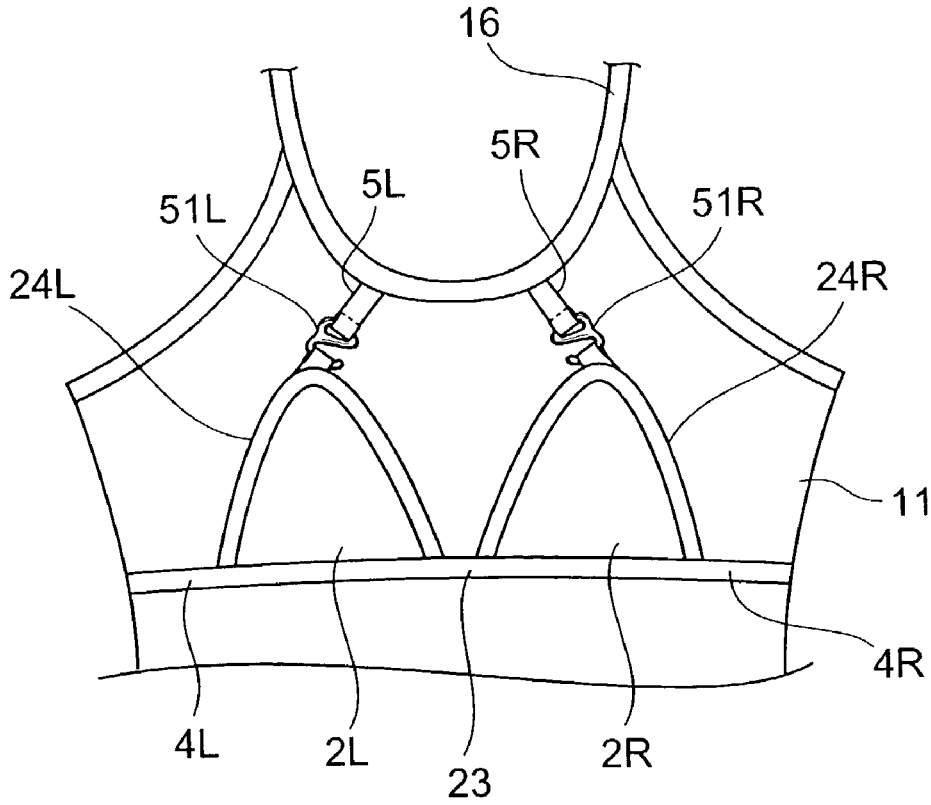
FIG. 17A is a front view of a swimsuit, showing a modified example of the swimsuit with cups in accordance with the present invention.
Figure 17B:
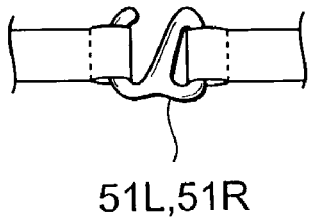
FIG. 17B is a view showing a hook shown in FIG. 17A.

Differences among the modified examples will now be explained. In FIG. 17A, the upper end part (the other end part) of the right (left) cup suspending cord 5R (5L) is sewn to the neck hole hem part 16. Attached to the lower end part (one end part) of the right (left) cup suspending cord 5R (5L) is a hook 51R (51L) shown in FIG. 17B. The hook 51R (51L) makes it possible for the right (left) cup suspending cord 5R (5L) to be attached to and removed from the right (left) cup portion 2R (2L).

Figure 18:
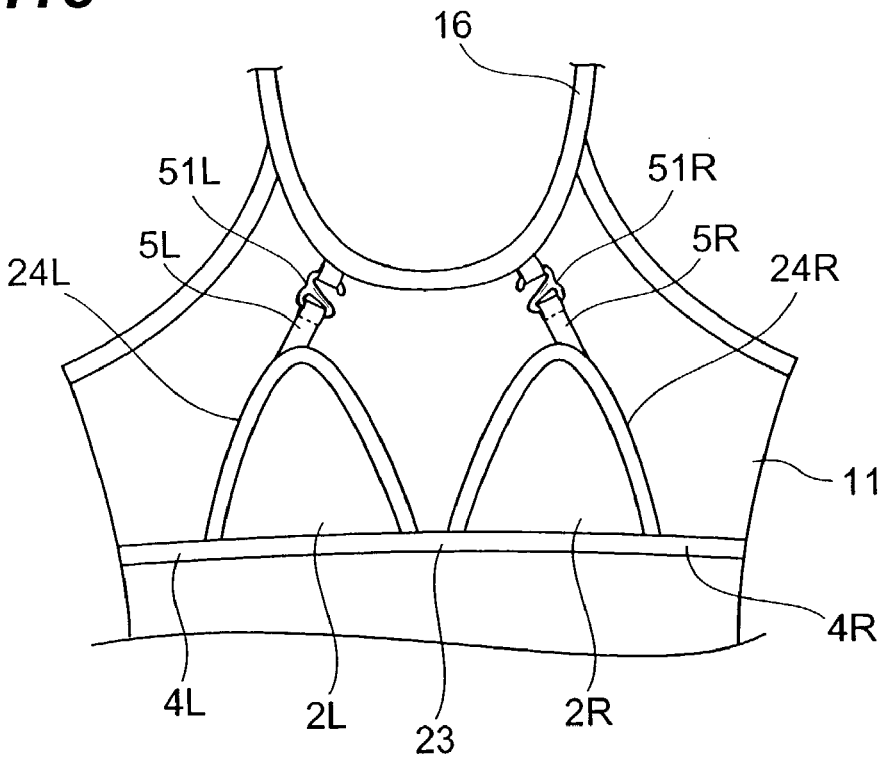
FIG. 18 is a front view showing another modified example of the swimsuit with cups in accordance with the present invention.

In FIG. 18, the hook 51R (51L) is attached to the upper end part of the right (left) cup suspending cord 5R (5L). Therefore, the right (left) cup suspending cord 5R (5L) is attachable to and removable from the neck hole hem part 16. The lower end part of the right (left) cup suspending cord 5R (5L) is sewn to the right (left) cup portion 2R (2L).

Figure 19:
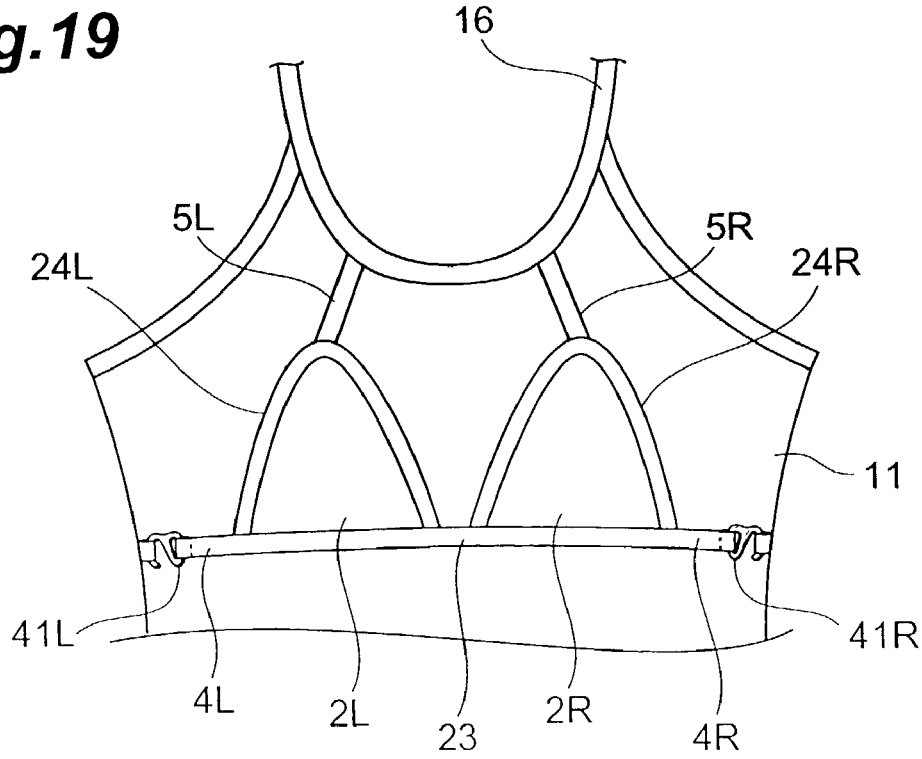
FIG. 19 is a front view showing another modified example of the swimsuit with cups in accordance with the present invention.

In FIG. 19, the lower tape member 23 extends further sidewise from the side end part of the right (left) cup portion 2R (2L), thereby constituting the right (left) side cloth portion 4R (4L). Hooks 41R, 41L are attached to both front end parts of the lower tape member 23. The hooks 41R, 41L make it possible for the right (left) side cloth portion 4R (4L) to be attached to and removed from the side part of the front body portion 11.

Figure 20:
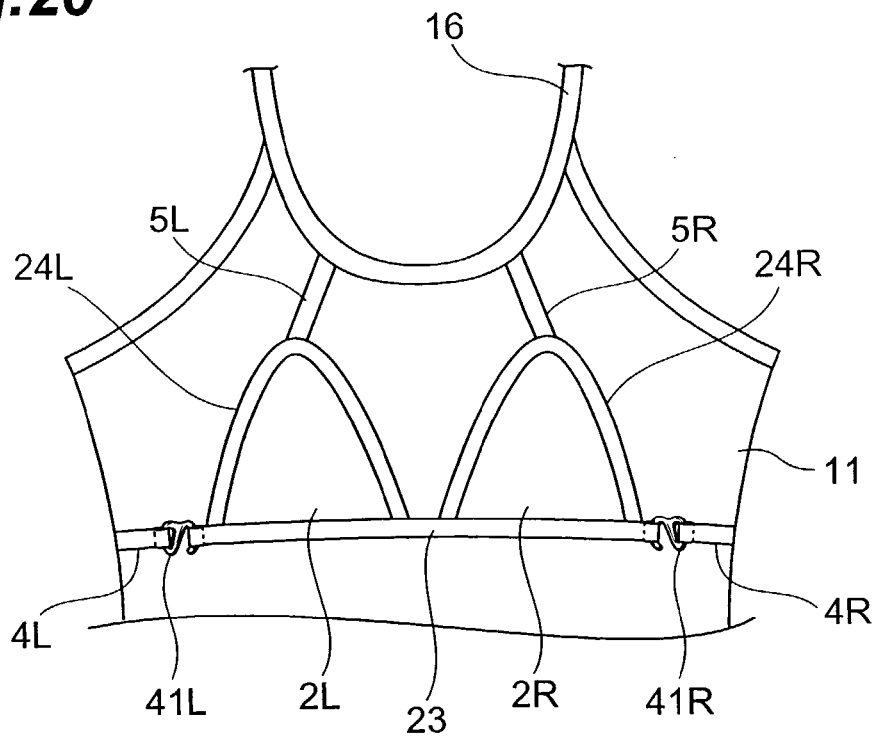
FIG. 20 is a front view showing another modified example of the swimsuit with cups in accordance with the present invention.

In FIG. 20, the lower tape member 23 is cut at the side end part of the right (left) cup portion 2R (2L). The part extending sidewise from thus cut position constitutes the right (left) side cloth portion 4R (4L). The right (left) side cloth portion 4R (4L) is sewn to the side part of the front body portion 11. A hook 41R (41L) is attached to the front end part (one end part) of the right (left) side cloth portion 4R (4L). The hook 41R (41L) makes it possible for the right (left) side cloth portion 4R (4L) to be attached to and removed from the side end part of the right (left) cup portion 2R (2L).

Figure 21:
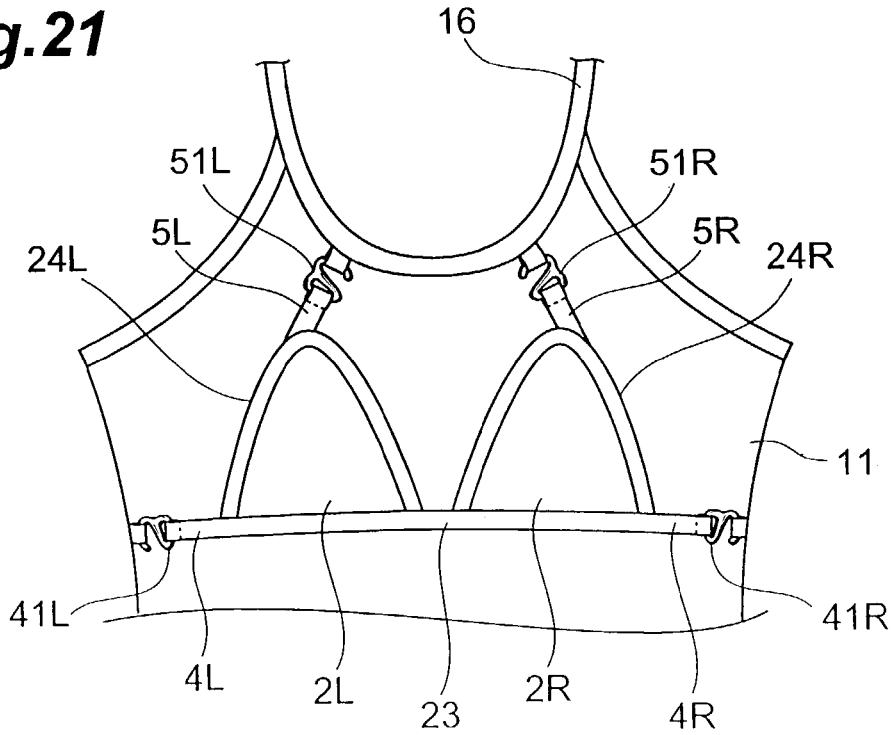
FIG. 21 is a front view showing another modified example of the swimsuit with cups in accordance with the present invention.

FIG. 21 is a modified example in which the characteristic features of FIGS. 18 and 19 are combined together. The hook 41R (41L) in the side part and the hook 51R (51L) on the neck hole side make it possible for the right (left) cup portion 2R (2L) to be attached to and removed from the clothing portion.

The hooks are only an example of connecting means, and the specific structure of connecting means is not limited to the hook as a matter of course. The present invention is applicable not only to swimsuits, but also widely to sport clothing products with cups in general, such as leotards and sport underwear.

PREFERRED MODES OF THE PRESENT INVENTION

Preferred modes of the present invention will be summarized in the following.

Preferably, the point at which respective extensions of first and second suspending members intersect is located in the vicinity of the front neck point of the wearer in a worn state. Here, the front neck point is the concept indicated by "Body Words for Clothing" defined in "JIS L 0111" (1983). The meaning of "vicinity" subtly varies depending on the build of the wearer, the design of the sport clothing product with cups, and the like. In the case of a standard build, it refers to an area which is centered at the front neck point and substantially ranges from the midpoint (the lower limit of the area) between the left and right shoulder points to the glabella (the upper limit of the area).

The sport clothing product with cups in accordance with the present invention may comprise a first side cloth portion having a pair of end parts and a second side cloth portion having a pair of end parts; wherein one end part of the first side cloth portion is attached to the first cup portion; wherein the other end part of the second side cloth portion is attached to the second cup portion; and wherein the other end part of the second side cloth portion is attached to the clothing portion. As a consequence, the right cup suspending cord and the right side cloth portion pull each other with the left cup portion disposed therebetween when the left arm is raised, whereas the left cup suspending cord and the left side cloth portion pull each other with the right cup portion disposed therebetween when the right arm is raised, whereby the underside becomes stable even at the time of exercising, and the stability of bust further improves. Similar effects are exhibited also when one end part of the side cloth portion is made attachable to and removable from the cup portion by connecting means. Similar effects are exhibited also when the other end part of the side cloth portion is made attachable to and removable from the cup portion by connecting means.

The sport clothing product with cups in accordance with the present invention may comprise a front center connecting portion for connecting first and second cup portions at the front center, whereas the front center connecting means may include connecting means, and the first and second cup portions may be made connectable and separable at the front center by the connecting means of the front center connecting portion. As a consequence, upon wearing the sport clothing product with cups, the bust can easily fit into the cup portions.

The sport clothing product with cups in accordance with the present invention may be configured such that the front center side of the first cup portion and the front center side of the second cup portion are attached to the clothing portion, whereas the clothing portion may be divided into one side and the other side at the front center thereof so as to be freely opened and closed by fastener means. As a consequence, it becomes easier to wear the sport clothing product with cups itself, and the bust can easily fit into the cup portions.

The sport clothing product with cups in accordance with the present invention may be configured such that the other end part of the first cup suspending member is made attachable to and removable from the front body portion of the clothing portion by connecting means, and the other end part of the second cup suspending member is made attachable to and removable from the front body portion of the clothing portion by connecting means. As a consequence, upon wearing the sport clothing product with cups, the bust can easily fit into the cup portions. Similar effects are exhibited also when one (the other) end part of the first (second) cup suspending member is made attachable to and retractable from the first (second) cup portion by connecting means.

The sport clothing product with cups in accordance with the present invention may be configured such that the first cup suspending member is a tape member, adapted to contract and stretch, having one end part attached to the upper edge part of the first cup portion and the other end part attached to the neck hole hem part of the front body portion of the clothing portion. As a consequence, the cup suspending tape member expands when the arm is raised greatly, whereby the movement of the cup portion is further alleviated.

The sport clothing product with cups in accordance with the present invention may be configured such that, in each of a first cup member constituting the main body of the first cup portion and a second cup portion constituting the main body of the second cup portion, a rim part of a side portion thereof from an upper end part to a lower end part has a smoothly bending arc form, whereas a tape member attached so as to extend along the arc-shaped rim part is smoothly drawn from the upper end part of the cup member toward the vicinity of the neck point of the wearer in a worn state, so that a front end part thereof is attached to the front body portion of the clothing portion (more preferably to the neck hole hem part by sewing or the like).

As a consequence, the tape member attached so as to extend along the arc-shaped rim part is smoothly drawn from the upper end part of the first (second) cup member toward the vicinity of the neck point, so as to function as the first (second) cup suspending member. Since it is drawn smoothly (i.e., without bending at the upper end part of the cup member), the stability in the movement of the first (second) cup portion is further enhanced.

Examples of the above-mentioned connecting means include sewing, buttons (for which the cup suspending member may have a ring-shaped front end which engages a button), hook-shaped engaging devices made of metals and resins, and hooks (male and female engaging buttons).

INDUSTRIAL APPLICABILITY

According to the sport clothing product with cups in accordance with the present invention, as explained in detail in the foregoing, the movements of cup portions caused by vigorous arm movements accompanying exercises are greatly alleviated, and the action of the cup suspending cord at the time when the arms are raised acts so as to lift the cup portions in so-called "centering" directions, whereby a special shaping function of beautifully centering and uplifting the bust at the time of exercising can be exhibited.

The invention claimed is:

1. A sport clothing product with cups comprising:

a body portion having a first defining portion for defining a first armhole, a second defining portion for defining a second armhole, and a neck hole defining portion for defining a neck hole;

a first cup portion and a second cup portion disposed in a front body portion of said body portion;

a first cup suspending member having a pair of end parts, wherein one of the end parts of the first cup suspending member is attached to the first cup portion, and the other of the end parts to the first cup suspending member is attached to the front body portion of the body portion; and a second cup suspending member having a pair of end parts, wherein one of the end parts of the second cup suspending member is attached to the second cup portion, and the other of the end parts to the second cup suspending member is attached to the front body portion of the body portion;

wherein the other end of the first cup suspending member is disposed approximate to the neck hole defining portion toward the second defining portion, and the other end of the second cup suspending member is disposed approximate to the neck hole defining portion toward the first defining portion.

2. A sport clothing product with cups according to claim 1, wherein said neck hole defining portion includes a neck hole hem part; and wherein the other end part of said first cup suspending member and the other end part of said second cup suspending member are attached to said neck hole hem part, in a front body portion.

3. A sport clothing product with cups according to claim 1, wherein the other end part of said first cup suspending member and the other end part of said second cup suspending member are attached to a front body portion at the same position.

4. A sport clothing product with cups according to claim 1, wherein said first cup suspending member and said second cup suspending member intersect each other near said front body portion.

5. A sport clothing product with cups comprising:

a clothing portion having a front body portion adapted to come into close contact with a human body;

first and second cup portions disposed on said human body side of said front body portion;

a first cup suspending member having a pair of end parts, wherein one end part of said first cup suspending member is attached to said first cup portion, and the other end part of said first cup suspending member is attached to the front body portion of the clothing portion; and a second cup suspending member having a pair of end parts, wherein one end part of said second cup suspending member is attached to said second cup portion, and the other end part of said second cup suspending member is attached to the front body portion of the clothing portion and;

wherein said first cup suspending member and said second cup suspending member intersect each other or respective extensions of said first and second cup suspending members intersect each other.

6. A sport clothing product with cups according to claim 5, wherein a position where said respective extensions of said first and second cup suspending members intersect each other is in the vicinity of a front neck point of a wearer in a worn state.

7. A sport clothing product with cups according to claim 5, further comprising:

a first side cloth portion having a pair of end parts wherein one end part of said first side cloth portion is attached to said first cup portion, and the other end part of said first side cloth portion is attached to said clothing portion; and a second side cloth portion having a pair of end parts, wherein one end part of said second side cloth portion is attached to said second cup portion; and the other end part of said second side cloth portion is attached to said clothing portion.

8. A sport clothing product with cups according to claim 5, further comprising a front center connecting portion for connecting said first and second cup portions at a front center thereof;

wherein said front center connecting portion includes connecting means; and wherein said first and second cup portions are made connectable and separable at the front center by said connecting means of said front center connecting portion.

9. A sport clothing product with cups according to claim 5, wherein the other end part of said first cup suspending member is made attachable to and removable from said front body portion of said clothing portion by connecting means; and wherein the other end part of said second cup suspending member is made attachable to and removable from said front body portion of said clothing portion by another connecting means.

10. A sport clothing product with cups according to claim 5, wherein one end of said first cup suspending member is made attachable to and removable from said first cup portion by connecting means; and wherein one end of said second cup suspending member is made attachable to and removable from said second cup portion by connecting means.

11. A sport clothing product with cups according to claim 5, wherein said first cup suspending member is a tape member, adapted to contract and stretch, having one end part attached to an upper edge part of said first cup portion and the other end part attached to a neck hole hem part of said front body portion of said clothing portion; and wherein said second cup suspending member is a tape member, adapted to contract and stretch, having one end part attached to an upper edge part of said second cup portion and the other end part attached to said neck hole hem part of said front body portion of said clothing portion.

12. A sport clothing product with cups according to claim 8, wherein, in each of a first cup member constituting a main body of said first cup portion and a second cup portion constituting a main body of said second cup portion, a rim part of a side portion thereof from an upper end part to a lower end part has a smoothly bending arc form; and wherein a tape member attached so as to extend along said arc-shaped rim part is smoothly drawn from an upper end part of said cup member toward the vicinity of a neck point of a wearer in a worn state such that a front end part thereof is attached to said front body portion of said clothing portion.

13. A sport clothing product with cups according to claim 8, wherein, in each of a first cup member constituting a main body of said first cup portion and a second cup portion constituting a main body of said second cup portion, a rim part of a side portion thereof from an upper end part to a lower end part has a smoothly bending arc form; and wherein a tape member attached so as to extend along said arc-shaped rim part is smoothly drawn from an upper end part of said cup member toward the vicinity of a neck point of a wearer in a worn state such that a front end part thereof is attached to said front body portion of said clothing portion, wherein said tape member for said first cup portion is drawn from said upper end part of said first cup member such that a front end part thereof is attached to a neck hole hem part of said front body portion of said clothing portion; and wherein said tape member for said second cup portion is drawn from said upper end part of said second cup member such that a front end part thereof is attached to said neck hole hem part of said front body portion of said clothing portion.

14. A sport clothing product with cups according to claim 10, comprising a front center connecting portion for connecting said first and second cup portions at a front center;

wherein each of said first and second side cloth portions includes a material having a width greater than that of said front center connecting portion and contraction and expansion properties.

15. A sport clothing product with cups according to claim 10, wherein each of said first and second side cloth portions has a width of 3 to 9 cm.

16. A sport clothing product with cups according to claim 10, wherein said first and second side cloth portions include at least one of power net, tricot, and triconet which includes an elastic thread and is partly provided with a difference in, strength of power by changing the number or thickness of said elastic thread or altering a knitting pattern thereof.

17. A sport clothing product with cups according to claim 10, wherein each of said first and second side cloth portions includes an intermediate part and upper and lower end parts respectively disposed on upper and lower sides thereof; and includes at least one of power net, tricot, and triconet in which said upper and lower end parts have a power higher than that of said intermediate part.

* * * * *